US007295788B2

(12) United States Patent
Nakai et al.

(10) Patent No.: US 7,295,788 B2
(45) Date of Patent: Nov. 13, 2007

(54) IMAGE FORMING APPARATUS AND PROCESS CARTRIDGE

(75) Inventors: Hiroshi Nakai, Kanagawa (JP); Yasuo Suzuki, Shizuoka (JP); Nozomu Tamoto, Shizuoka (JP); Takahiko Tokumasu, Tokyo (JP); Kazahiko Watanabe, Tokyo (JP); Kohichi Ohshima, Shizuoka (JP); Noboru Tsukude, Kanagawa (JP); Nekka Matsuura, Kanagawa (JP); Hiroshi Ikuno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 11/113,241

(22) Filed: Apr. 25, 2005

(65) Prior Publication Data

US 2005/0244176 A1 Nov. 3, 2005

(30) Foreign Application Priority Data

Apr. 26, 2004 (JP) ..... 2004-129637
May 10, 2004 (JP) ..... 2004-139846

(51) Int. Cl.
*G03G 15/00* (2006.01)
*G03G 15/02* (2006.01)
*G03G 15/09* (2006.01)

(52) U.S. Cl. ..... 399/44; 399/159; 399/168; 399/346; 430/111.41

(58) Field of Classification Search ..... 399/44, 399/168, 174, 175, 176, 346, 159; 430/902, 430/110.1, 111.41
See application file for complete search history.

(56) References Cited

U.S. PATENT DOCUMENTS

| | | | | |
|---|---|---|---|---|
| 6,295,438 | B1 * | 9/2001 | Fujishiro et al. | 399/346 |
| 6,345,162 | B1 * | 2/2002 | Ozawa et al. | 399/44 X |
| 6,721,523 | B2 | 4/2004 | Sugiura et al. | 399/176 |
| 7,082,284 | B2 * | 7/2006 | Nishida et al. | 399/346 |
| 2002/0037187 | A1 * | 3/2002 | Kai et al. | 399/346 |

(Continued)

FOREIGN PATENT DOCUMENTS

| | | |
|---|---|---|
| JP | 56-45219 | 10/1981 |

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes an object to be charged whose surface moves. A charging device for charging the object uses an electrical discharge generated by applying a voltage including an alternating current component to a charging member provided in contact with or in proximity to the object. A latent image forming device forms an electrostatic latent image on the surface of the object. A developing device causes a two-component developer to come into contact with the image portion of the electrostatic latent image formed by the latent image forming device and affixes toner thereto. A protective substance is present on the surface of the object in the discharge region for charging the object, and the saturation magnetization of the carrier of the two-component developer with respect to an applied magnetic field of 1000 oersted is 40 to 80 emu/g.

10 Claims, 15 Drawing Sheets

U.S. PATENT DOCUMENTS

| | | | | |
|---|---|---|---|---|
| 2002/0106574 | A1* | 8/2002 | Haneda et al. | 430/124 |
| 2003/0039494 | A1 | 2/2003 | Shakuto et al. | 399/357 |
| 2004/0042823 | A1 | 3/2004 | Sugiura et al. | 399/174 |
| 2004/0126902 | A1* | 7/2004 | Nishiya et al. | 436/526 |
| 2004/0165919 | A1* | 8/2004 | Nishida | 399/346 |
| 2004/0202495 | A1* | 10/2004 | Koike et al. | 399/159 |
| 2004/0213600 | A1 | 10/2004 | Watanabe et al. | 399/159 |
| 2004/0259016 | A1* | 12/2004 | Oya et al. | 430/126 |
| 2005/0152722 | A1* | 7/2005 | Tawada et al. | 399/346 |
| 2005/0191099 | A1* | 9/2005 | Yamaguchi et al. | 399/346 |
| 2006/0045592 | A1* | 3/2006 | Shirodai et al. | 399/346 |
| 2006/0204259 | A1 | 9/2006 | Watanabe et al. | |

FOREIGN PATENT DOCUMENTS

| | | | |
|---|---|---|---|
| JP | 2002-55580 | | 2/2002 |
| JP | 2002-156877 | | 5/2002 |
| JP | 2002-207308 | | 7/2002 |
| JP | 2002-214828 | A * | 7/2002 |
| JP | 2002-229227 | | 8/2002 |
| JP | 2002-244487 | | 8/2002 |
| JP | 2002-244516 | | 8/2002 |
| JP | 2005-003808 | A * | 1/2005 |

* cited by examiner

FIG. 15

| X | SURFACE SPEED OF PHOTO-RECEPTOR V [mm/sec] | Vpp [V] | f [Hz] | ELEMENTAL PROPORTION OF ZINC STEARATE [%] | PRESENCE OF CLOUDING (BY VISUAL OBSERVATION) ON SURFACE OF PHOTO-RECEPTOR | FILM THICKNESS REDUCTION [μ/100h] |
|---|---|---|---|---|---|---|
| 1544 | 125 | 2120 | 877.2 | 0.36 | | 0.00 |
| 1544 | 125 | 2120 | 877.2 | 0.29 | | 0.16 |
| 1544 | 125 | 2120 | 877.2 | 0.21 | | 0.52 |
| 1544 | 125 | 2120 | 877.2 | 0.00 | | 1.30 |
| 8027 | 185 | 3000 | 1350 | 0.00 | | 6.74 |
| 8027 | 185 | 3000 | 1350 | 0.24 | | 5.83 |
| 8027 | 185 | 3000 | 1350 | 0.60 | | 4.47 |
| 8027 | 185 | 3000 | 1350 | 1.19 | | 2.23 |
| 8027 | 185 | 3000 | 1350 | 1.25 | | 2.01 |
| 8027 | 185 | 3000 | 1350 | 1.70 | | 0.30 |
| 8027 | 185 | 3000 | 1350 | 1.87 | | 0.00 |
| 8027 | 185 | 3000 | 1350 | 2.40 | | 0.00 |

IMAGE FORMING APPARATUS AND PROCESS CARTRIDGE

BACKGROUND OF THE INVENTION

1. Field of the Invention

The present invention relates to a copy machine, laser printer, facsimile device, or other image forming apparatus, and to a process cartridge thereof.

2. Description of the Related Art

The type of image forming apparatus that employs an electrophotographic process has conventionally had a charging device for charging the surface of a photoreceptor as an image carrier. A charging system that uses adjacent discharge is one example of a charging system used in the charging device. This is a system for charging the surface of a photoreceptor by adjacent discharge in which a charging member is brought into contact with, or brought near but not into contact with, the photoreceptor surface. Since increased resolution, miniaturization, and other features have been increasingly desired in recent years, increased resolution and small size have become objects in the charging device. A charging device with an adjacent discharge that uses a charging member in contact with or in proximity to a photoreceptor is effective for achieving these objects because a large-scale charging device is not required.

However, it has been learned that the photoreceptor surface is degraded due to the electrical discharge being concentrated in the vicinity of the photoreceptor surface in a charging system that uses adjacent discharge. Degradation of the photoreceptor surface by adjacent discharge differs from mechanical scraping in that it occurs even when there is no member in contact with the photoreceptor. As will be described hereinafter with reference to the drawings, degradation of the photoreceptor surface by adjacent discharge can be identified by the scraping or thinning of the film on the photoreceptor surface.

Enhancing frictional resistance by coating the surface of the photoreceptor with amorphous silicone carbide or enhancing frictional resistance by dispersing alumina or another inorganic substance into the charge transport layer (CTL) of the photoreceptor surface have been proposed in Japanese Unexamined Patent Application Publication No. 2002-207308, 2002-229227, and other publications, for example, in order to prevent the thickness of the film on the photoreceptor surface from being reduced. Although durability against mechanical abrasion is enhanced with this type of configuration, this type of configuration still cannot prevent chemical degradation of the photoreceptor surface by adjacent discharge.

Japanese Unexamined Patent Application Publication Nos. 2002-55580 and 2002-244487, for example, disclose image forming apparatuses that are provided with a device for applying a lubricant such as zinc stearate to the surface of the photoreceptor in order to both prevent an increase in the drive torque of a photoreceptor as a member being cleaned and to prevent toner or additives from fusing to the surface of the photoreceptor over long periods of time. This type of lubricant application is performed for the purpose of lowering the friction coefficient of the photoreceptor surface.

Japanese Unexamined Patent Application Publication Nos. 2002-244516 and 2002-156877, for example, propose application of a lubricant such as zinc stearate to the surface of the photoreceptor in order to solve the problem of notable occurrence of filming and fusing of toner on the photoreceptor surface in a case where the voltage applied to the charging member is a voltage in which an alternating current component is superposed on a direct current component.

Japanese Patent Application No. 2003-039538, for example, proposes an image forming apparatus in which zinc stearate is applied to the photoreceptor surface to protect it from degradation by the electrical discharge of the charging member.

The inventors (nine inventors) discovered that a necessary quantity of a protective substance must be interposed in the discharge area in order to prevent the film thickness reduction described above from occurring. Specifically, it was learned from the results of experimentation described hereinafter that degradation of the photoreceptor surface by electrical discharge is inhibited by the presence of a protective substance.

However, when such a protective substance is applied to the photoreceptor surface, the toner and the photoreceptor surface come into contact with each other at the developing part, whereby the inside of the developing device can become contaminated with the protective substance thus applied. Particularly when a large quantity of manuscript having a low image area ratio is output, since the majority of the toner on the development roller is returned with no change thereof to the inside of the developing device after coming into contact with the photoreceptor surface, the protective substance is scratched off by the toner and is entrained back into the developing device. When the inside of the developing device is contaminated with the protective substance, the characteristics of the developing agent are adversely affected, and it becomes impossible to maintain good image quality. When the amount of charge is reduced, for example, drawbacks occur whereby smudges, blocky lettering, and other types of image degradation occur, and a satisfactory image cannot be maintained over time. Furthermore, when the effects whereby the toner scrapes off the protective substance in this manner are severe, it also becomes necessary to increase the amount of protective substance to be supplied, which is not preferable in terms of device miniaturization. Therefore, a requirement exists for supplying this protective substance with better consistency and efficiency.

SUMMARY OF THE INVENTION

An object of the present invention is to provide an image forming apparatus and a process cartridge in which a charging system that uses adjacent discharge is employed, wherein the image forming apparatus is not only capable of preventing degradation of the photoreceptor surface caused by adjacent discharge, but is also devoid of adverse effects on the developing agent while at the same time being further reduced in size.

Another object of the present invention is to provide an image forming apparatus and process cartridge capable of maintaining a satisfactory image over a long period of time.

In accordance with the present invention, an image forming apparatus comprises an image support for supporting an electrostatic latent image; a charging device for charging the surface of the image support by application of a voltage to a charging member; and a developing device for supporting a developer on a developer support, transporting the developer to a development area facing the image support, developing the latent image on the image support, and converting the image to a toner image. The friction coefficient between the toner and the image support is 0.7 or lower.

In accordance with the present invention, there is provided a process cartridge in which an image support, and at least one of a developing device for forming a toner image on the surface of the image support and a charging device for charging the image support surface are integrally formed, and which is demountable with respect to the main body of an image forming apparatus. The image forming apparatus comprises an image support for supporting an electrostatic latent image; a charging device for charging the surface of the image support by application of a voltage to a charging member; and a developing device for supporting a developer on a developer support, transporting the developer to a development area facing the image support, developing the latent image on the image support, and converting the image to a toner image, the friction coefficient between the toner and the image support being 0.7 or lower.

In accordance with the present invention, an image forming apparatus comprises an object to be charged whose surface moves; a charging device for charging the object to be charged using an electrical discharge generated by applying a voltage comprising an alternating current component to a charging member provided in contact with or in proximity to the object to be charged; a latent image forming device for forming an electrostatic latent image on the surface of the object charged by the charging device; and a developing device for causing a two-component developer to come into contact with the image portion of the electrostatic latent image formed by the latent image forming device and affixing toner thereto. A protective substance is present on the surface of the object to be charged in the discharge region for charging the object to be charged, and the saturation magnetization of the carrier of the two-component developer with respect to an applied magnetic field of 1000 oersted is 40 to 80 emu/g.

In accordance with the present invention, a process cartridge integrally comprises an object to be charged whose surface moves; a charging device for charging the object to be charged using an electrical discharge generated by applying a voltage comprising an alternating current component to a charging member provided in contact with or in proximity to the object to be charged; a developing device for causing a two-component developer to come into contact with the image portion of an electrostatic latent image formed by eliminating the charge on the surface of the object charged by the charging device according to image information; and a feeding device for feeding a protective substance to the surface of the object to be charged in the discharge area for charging the object to be charged. The saturation magnetization of the carrier of the two-component developer with respect to an applied magnetic field of 1000 oersted is 40 to 80 emu/g.

BRIEF DESCRIPTION OF THE DRAWINGS

The above and other objects, features, and advantages of the present invention will become more apparent from the following detailed description taken with the accompanying drawings in which:

FIG. 15 is a table showing the results of the photoreceptor surface state and the ratio (%) of atoms of zinc ($Z_n$) detected by XPS;

DESCRIPTION OF THE PREFERRED EMBODIMENTS

The present invention will be described in detail hereinafter with reference to the drawings.

First Embodiment

Following is a description of the present embodiment, which is obtained by applying the present invention to the image forming apparatus.

Figure 1:
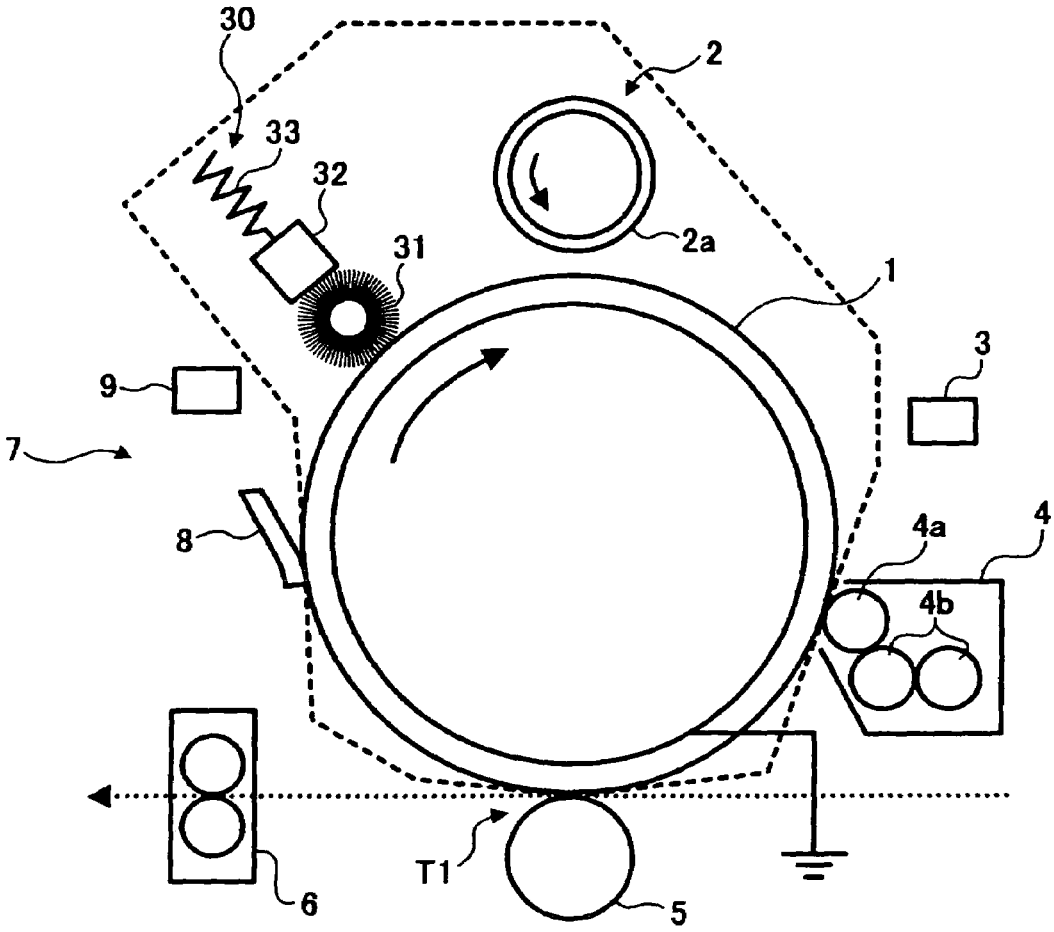
FIG. 1 is a drawing showing the configuration of the main components of the image forming apparatus according to the embodiments of the present invention.

First, the basic structure of the image forming unit provided with the image forming apparatus will be described using FIG. 1. In FIG. 1, this image forming unit is made up of a drum-shaped photoreceptor 1 as an image carrier; a charging device 2; an exposing device 3 for inscribing an electrostatic latent image on the photoreceptor 1; a developing device 4; a cleaning device 7 for removing the image forming substance from the surface of the photoreceptor 1; and other components.

In the image forming apparatus thus configured, the photoreceptor 1 is rotatably driven by a driving device not shown in the drawing, and the surface thereof is charged in the prescribed polarity by the charging device 2. The exposing device 3 is then driven based on image information read from the outside, whereby an electrostatic latent image is formed on the charged region (image formation region) of the photoreceptor 1. This electrostatic latent image is developed by the developing agent (toner) fed from the developing device 4 and is converted to a visible toner image.

While this toner image is being formed on the photoreceptor 1, transfer paper as an image recording medium is fed towards the photoreceptor 1 from a paper feeding unit not shown in the drawing. This transfer paper is transported to a transferring device 5 positioned opposite the photoreceptor 1 at a timing at which it is placed over the toner image on the photoreceptor 1, and the toner image on the photoreceptor 1 is transferred in a transfer nip T1. Then, after the transfer paper has been mechanically separated from the photoreceptor 1, it is conveyed to a fixing device 6, and the toner image is fixed.

The residual toner that remains on the surface of the photoreceptor 1 after the paper has passed through the transfer nip T1 is removed and recovered from the photoreceptor 1 by the blade 8 of the cleaning device 7. The residual charge on the photoreceptor surface from which the residual transfer toner has been removed is then removed by a charge removing device 9. The application device 30 provided to the image forming apparatus of the present embodiment will be described in detail hereinafter.

In the image forming apparatus of the present invention, the photoreceptor, the charging member, the developing device, and the cleaning device are configured in integrated fashion and a parts of a process cartridge that can be detached from the main body of the image forming apparatus. Since this process cartridge is replaced as a whole, the quantity of the protective substance contained in the application device 30, the initial film thickness of the photoreceptor, and other quantities can easily be set to levels that are appropriate with respect to each other in a manner suitable for the present invention.

Degradation of the photoreceptor surface by adjacent discharge will next be described based on experimental examples.

[Experiment 1]

Figure 2B:
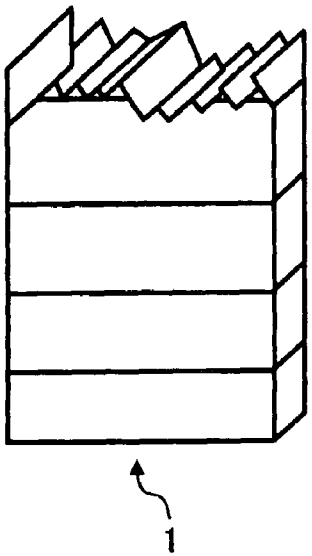
FIG. 2B is a diagram showing the state of the photoreceptor surface when the photoreceptor surface is degraded by electrical discharge.
Figure 2A:
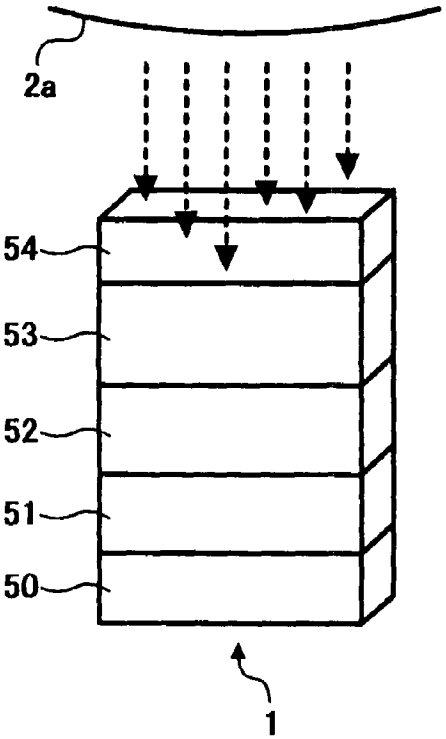
FIG. 2A is a cross-sectional diagram of the photoreceptor.

The inventors (nine inventors) performed the following experiment in order to investigate the state of degradation of the surface of the photoreceptor 1 that becomes severe when a discharge based on the application of alternating current is initiated using charging members positioned in contact with or in proximity to each other. In order to prevent degradation of the photoreceptor surface caused by mechanical scraping, the charging member 2*a* was disposed out of contact with the surface of the photoreceptor 1, as shown in FIG. 2A. All members in contact with the photoreceptor 1 were also removed. The photoreceptor 1 was charged continuously for approximately 150 hours using a non-contacting rotatable roller-shaped charging member 2*a* (hereinafter referred to as "charging roller 2*a*") by the application of a voltage in which an alternating current (AC) voltage bias was superposed on a direct current (DC) bias. As shown in FIG. 2A, the photoreceptor 1 used in the present experiment was provided with an underlayer 51 as an insulating layer on the base layer 50. Furthermore, a charge generation layer (CGL) 52, a charge transport layer (CTL) 53, and a surface protection layer (FR) 54 were layered in sequence thereon.

Figure 3:
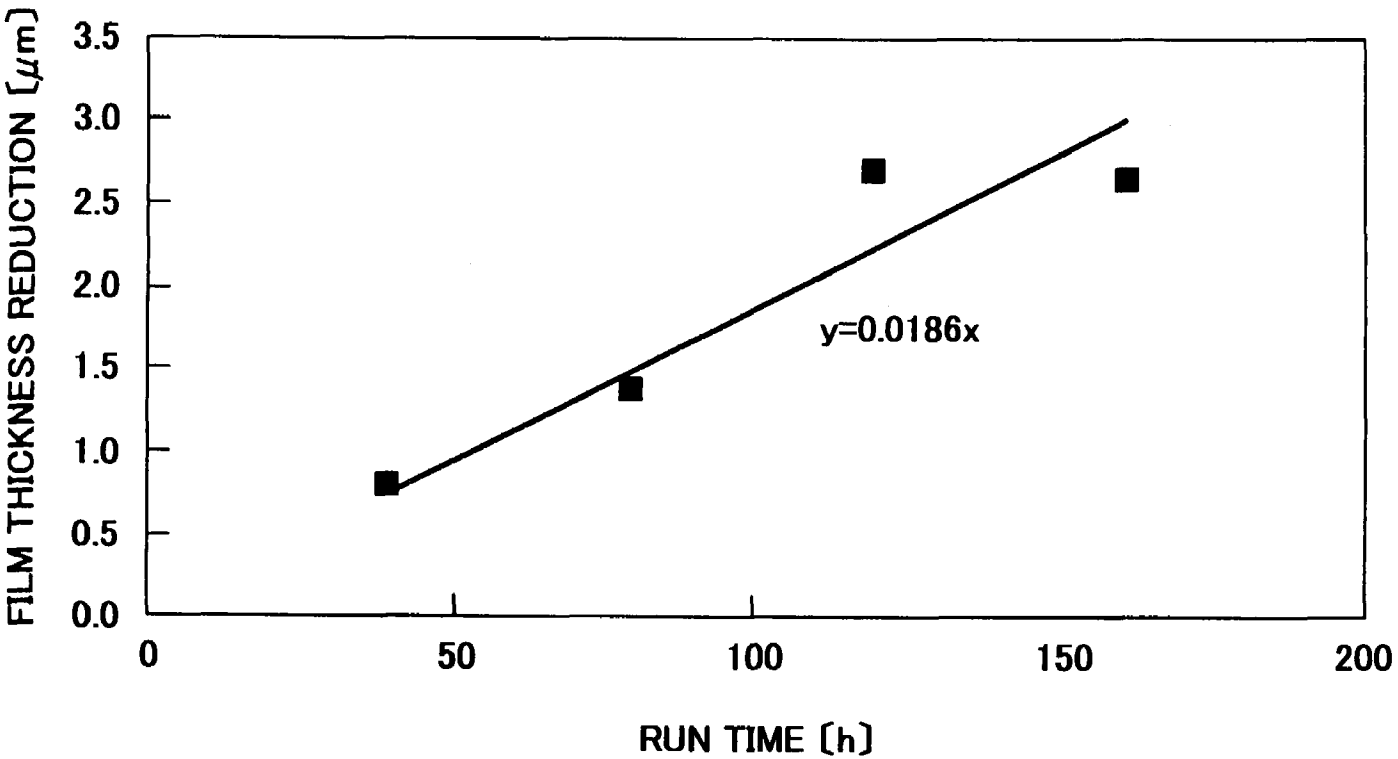
FIG. 3 is a graph showing the results of measuring the film thickness change of the photoreceptor surface when the charging member only was positioned in proximity to the photoreceptor surface but not in contact therewith, and a continuous 150-hour charge test was performed.

In FIG. 3, the amount of film thickness reduction on the surface of the photoreceptor 1 is plotted with respect to the charging time. It is apparent from this graph that the film thickness of the photoreceptor 1 is reduced as the charging time is increased. It is inferred that significant chemical degradation occurs on the surface of the charged photoreceptor 1 during a discharge based on the application of alternating current, and that film thickness decreases as shown in FIG. 2B. The details of the mechanism whereby significant chemical degradation of the photoreceptor surface occurs during a discharge based on the application of alternating current are currently under investigation, but the following facts became clear upon analysis of the surface of the photoreceptor 1 after charging according to this experimental example 1. Carboxylic acid was detected, which was considered to be a decomposition product of the polycarbonate used as the binder resin constituting the charge transport layer 53 and the surface protection layer 54.

From the assumption that the component constituting the photoreceptor 1 had decomposed, the following can be considered to be the mechanism by which the film thickness of the photoreceptor 1 is reduced.

When the surface protection layer 54 of the photoreceptor 1 surface is irradiated with the energy of particles (ozone, electrons, excited molecules, ions, plasma, and the like) generated from the electrical discharge by the charging roller 2*a* positioned in contact or proximity therewith, this energy resonates with the bonding energy of the molecules constituting the surface of the photoreceptor 1, the surface protection layer 54, and the like, and is absorbed. This effect provokes reduction of the degree of intertwining of the polymer chain forming the outermost surface layer, reduction in the molecular weight due to breakage of the resin molecule chain, evaporation of the resin or decomposition products, and other types of chemical degradation. It is suggested that the film thickness in the outermost surface layer of the photoreceptor 1 surface occurs is gradually reduced in conjunction with this type of chemical degradation.

The energy of the particles generated by the electrical discharge of the charging roller 2*a* in a contacting or proximal position is considered to be the cause of film thickness reduction. Therefore, this effect is not considered in the present experimental example 1 to be a problem that is specific to polycarbonate, which is the substance that forms the surface protection layer 54 or charge transport layer 53, and the same phenomenon is also considered to occur in the photoreceptor 1 in which another material is used.

[Experiment 2]

An experimental example will next be described which shows that the significant chemical degradation of the photoreceptor surface during a discharge based on the application of alternating current can be inhibited by adding a protective substance on the photoreceptor.

Figure 4A:
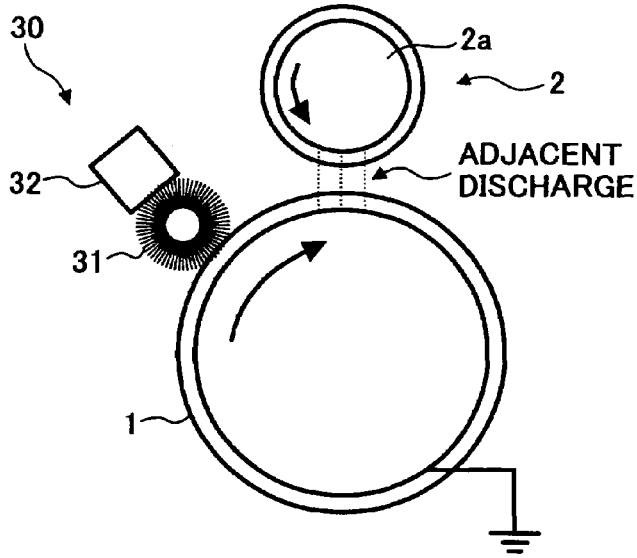
FIG. 4A is a diagram showing the experimental device relating to minimization of photoreceptor degradation by electrical discharge.
Figure 4B:
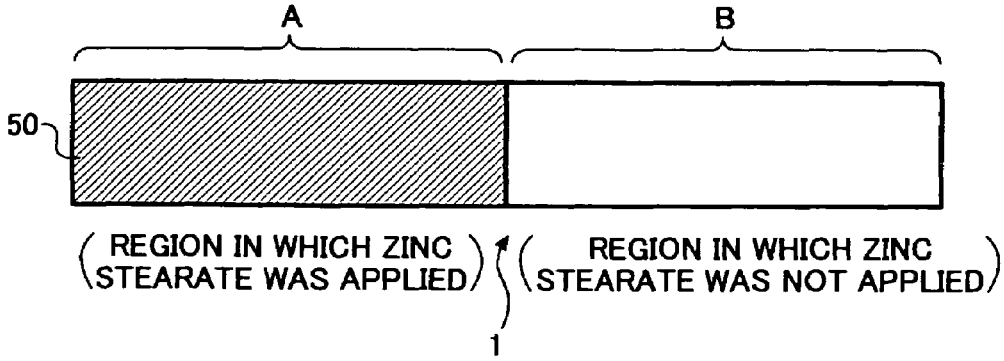
FIG. 4B shows the areas on the photoreceptor surface in which the zinc stearate protective substance was and was not applied.

FIG. 4A is a schematic drawing of the experimental device for confirming that the significant chemical degradation of the photoreceptor 1 surface during a discharge based on the application of alternating current is inhibited by the presence of the protective substance 32 on the photoreceptor 1. In order to compare the degradation state of the photoreceptor surface in the presence or absence of the protective substance 32, a region A (in the drawing, the half on the left side in the width direction of the photoreceptor) in which the protective substance was applied on the photoreceptor surface as shown in FIG. 4B was provided together with a region B (the half on the right side in the width direction of the photoreceptor) in which the protective substance was not applied. Specifically, the protective substance application device 30 (the structure and operation of which will be described hereinafter) was mounted so as to apply the protective substance only to the area of the surface of the photoreceptor 1 corresponding to the left half in the width direction thereof with a fur brush 31, and zinc stearate as the protective substance 32 was applied only to region A.

In order to ensure that degradation of the photoreceptor 1 surface caused by mechanical scraping did not occur, all members other than the charging roller 2*a* and the protective substance application device 30 were removed in advance. The charging device 2 and the protective substance application device 30 were also continuously driven along with the photoreceptor 1, and the degradation state of the photoreceptor 1 surface was investigated. The experimental conditions were as described below.

(Experimental Conditions)

Figure 5:
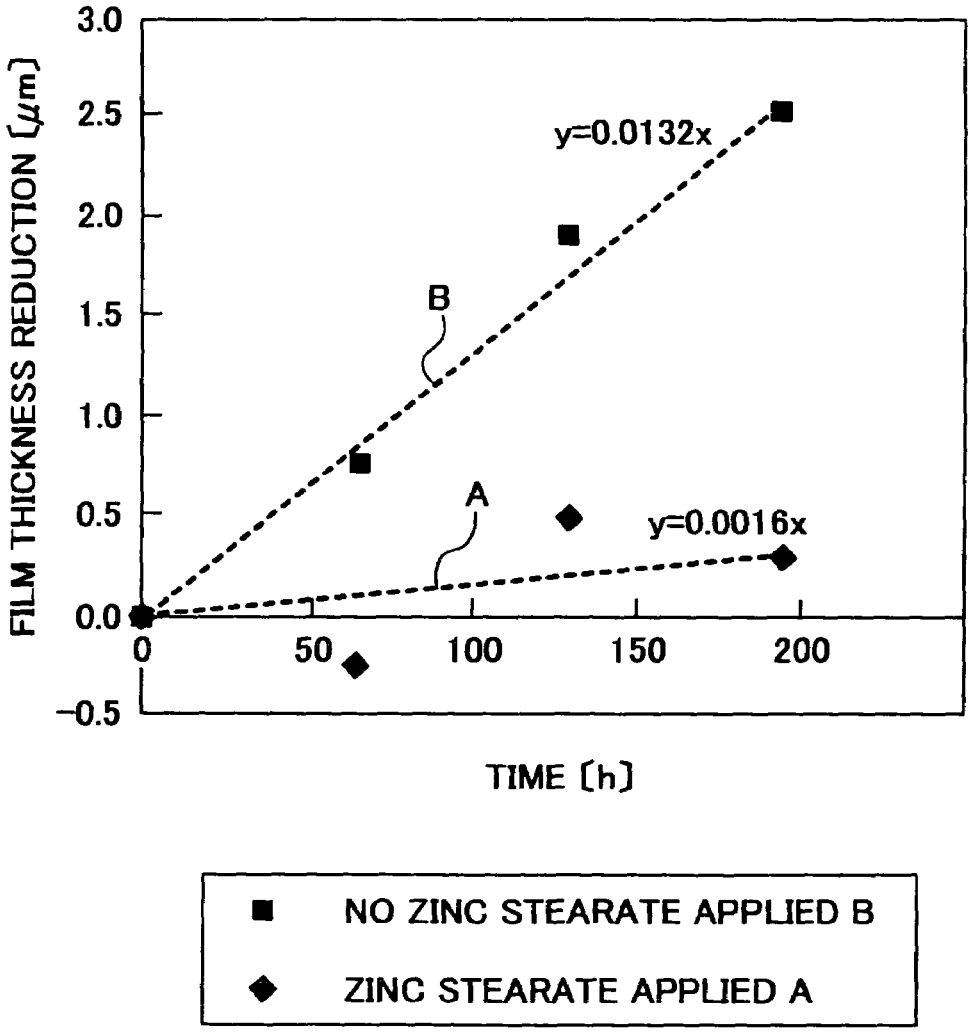
FIG. 5 is a graph obtained by plotting the amount of film thickness reduction on the photoreceptor surface with respect to charging time, and the friction coefficient of the photoreceptor surface with respect to time when application of two quantities of zinc stearate is performed.

Charging conditions:

Vpp (AC voltage peak-to-peak voltage value)=2.12 kV f (frequency of AC voltage)=877.2 Hz DC voltage value=−660 V Travel speed v of photoreceptor surface=125 mm/s Linear speed of fur brush 31=216 mm/s Protective substance 32: zinc stearate In FIG. 5, the amount of film thickness reduction on the surface of the photoreceptor 1 is plotted with respect to the charging time. It was apparent from this graph that the film thickness reduction increased as the charging time was increased.

The following facts were apparent when the film thickness of the photoreceptor 1 after the abovementioned experiment was performed continuously for 200 hours was compared with the film thickness of the photoreceptor 1 before the experiment. Whereas the film thickness was reduced by 2.5 μm in region B in which the protective substance 32 was not applied, the film thickness reduction in region A in which the protective substance 32 was applied was $1/8^{th}$ or less that of the film thickness reduction in region B.

When the surface of the photoreceptor 1 was visually observed after the abovementioned experiment had been performed continuously for 200 hours, the photoreceptor 1 surface had turned white and had deteriorated in the region B in which the protective substance 32 was not applied, whereas the same mirror finish as that of the new photoreceptor 1 surface prior to the experiment was maintained in the region A in which the protective substance 32 was applied.

From these results, it was learned that the significant chemical degradation of the photoreceptor surface during a discharge based on the application of alternating current can be minimized by applying a protective substance to the surface of the photoreceptor 1.

Therefore, in the present embodiment, a protective substance supplying device is provided for supplying the protective substance 32 to the photoreceptor surface in order to prevent degradation of the photoreceptor surface due to adjacent discharge. The specific structure thereof will be described in detail hereinafter.

As shown in FIG. 1, the protective substance application device 30 serves as a protective substance supplying device for supplying the protective substance 32 to the photoreceptor surface. This protective substance application device 30 is disposed so as to face the photoreceptor 1 on the downstream side in the rotation direction of the photoreceptor 1 with respect to the cleaning device 7, and on the upstream side in the rotation direction of the photoreceptor 1 with respect to the charging device 2. The protective substance application device 30 has a fur brush 31 as an application member, and also has the protective substance 32 and a pressing spring 33 for pushing the protective substance towards the fur brush. The protective substance 32 is in the form of a solid that is molded into a bar. The distal end of the fur brush 31 is in contact with the photoreceptor surface, and the protective substance 32 is scooped up by the end of the brush rotating on its axis, is carried on the brush to the position of contact with the photoreceptor surface, and is applied to the photoreceptor surface. The protective substance 32 molded into the shape of a bar is pushed towards the fur brush 31 with a prescribed pressure by the pressing spring 33. Thus, even when the protective substance 32 is worn down by the scraping of the fur brush 31 over time, a trace quantity of the protective substance 32 can be uniformly fed to the fur brush 31 at all times.

The method whereby the protective substance 32 is applied by the protective substance application device 30 was described above, but any method may be used insofar as it provides a means whereby the protective substance 32 can be present in the appropriate state on the surface of the photoreceptor 1.

The charging device 2 used in the present embodiment will next be described in detail.

The charging device 2 according to the present embodiment charges the photoreceptor by a discharge based on the application of alternating current from the charging roller 2*a* positioned facing the charging device 2 so as not to be in contact with the charging device 2, but in close proximity thereto. A method exists whereby the photoreceptor is charged by the discharge based on the application of alternating current from the charging roller 2*a* brought into contact in the opposing position. When this method is applied, an elastic member is preferably used whereby the contact between the photoreceptor 1 surface and the charging roller 2*a* is enhanced, and no mechanical stress is applied to the photoreceptor 1. However, when an elastic member is used, the width of the charging nip is increased, which sometimes causes the protective substance to more easily adhere to the charging roller. Charging without contact is therefore advantageous for improving the durability of the body being charged.

Figure 6:
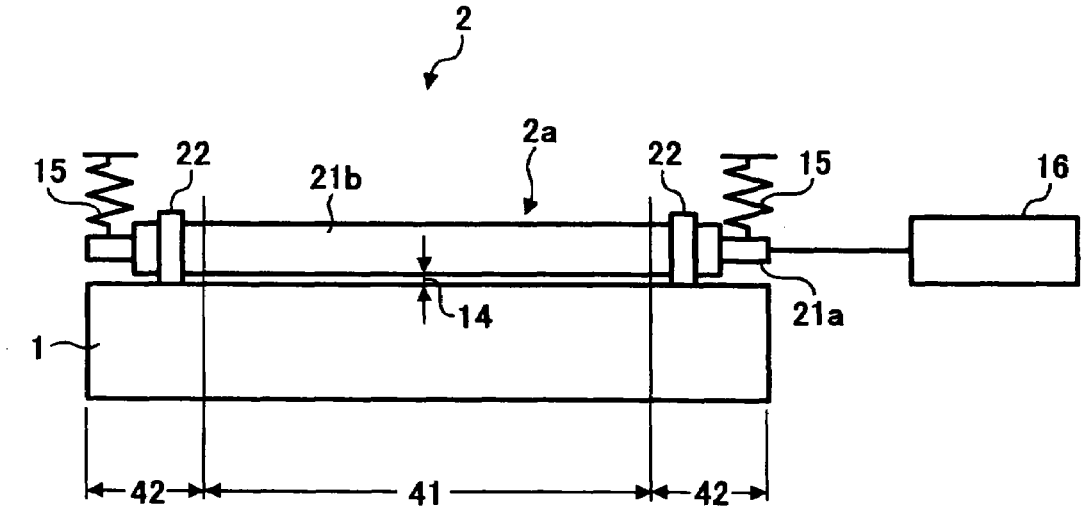
FIG. 6 is a diagram showing the general structure of the charging device used in the image forming apparatus according to the embodiments.

FIG. 6 is schematic diagram of the charging device 2 and photoreceptor 1. The charging device 2 is made up of the charging roller 2*a* as the charging member, a spacer 22, a spring 15, and a power supply 16. The charging roller 2*a* has an axle 21*a* and a roller unit 21*b* as the charging unit. Among these components, the roller unit 21*b* faces the photoreceptor 1 and has the function of charging the photoreceptor surface, and is configured so as to be able to rotate in conjunction with the rotation of the axle 21*a*. The charging roller 2*a* is provided with a spacer 22 as a gap-retaining member so that the roller unit 21*b* on the surface of the charging roller is positioned facing the photoreceptor surface with a minute gap. By this spacer 22, the portion of the photoreceptor 1 surface opposite the image formation region 41 in which the image is formed is disposed so as not to be in contact with the photoreceptor 1.

The dimensions of the roller unit 21*b* in the longitudinal direction are set so as to be longer than the image formation region of the photoreceptor 1, and the abovementioned minute gap 14 is formed by placement of the spacer 22 into contact with the non-image formation region 42 of the photoreceptor 1. A configuration is adopted whereby the charging roller 2*a* rotates as it rolls along the surface of the photoreceptor 1 via the spacer 22.

The minute gap 14 is configured so that the part thereof where the roller unit 21*b* and the photoreceptor 1 are in closest proximity is 1 to 100 μm. The distance of closest approach is more preferably 30 to 65 μm. The device of the present embodiment is configured so that this distance is 50 μm.

A spring 15 for pushing the charging roller 2*a* towards the object being charged is fitted to the axle 21*a*. It thereby becomes possible to maintain the minute gap 14 with good precision.

A power supply 16 used for charging is connected to the charging roller 2*a*, and the surface of the photoreceptor 1 is uniformly charged by a discharge based on the application of alternating current in the minute gap between the surface of the photoreceptor 1 and the surface of the charging roller 2*a*. In the present embodiment, a configuration is adopted whereby an alternating voltage in which an AC voltage as an alternating current component is superposed on a DC voltage as a direct current component is applied to the charging unit of the charging roller 2*a*. By using an alternating voltage, the effects of fluctuation in the charge potential caused by variation of the minute gap and the like are minimized, and it becomes possible to perform uniform charging.

The abovementioned charging roller 2*a* is composed of a metal core as an electroconductive support having a cylindrical shape, and a resistance adjustment layer formed on the external peripheral surface of the metal core. In the present embodiment, the charging roller 2*a* has a diameter of 10 mm.

A rubber member or other known material, for example, may be used as the surface of the charging roller 2*a*, but a configuration in which a resin material is used is more preferred. This is because when a rubber member is used, it becomes difficult to maintain the minute gap with respect to the photoreceptor 1 due to moisture absorbance or flexing of the rubber. Under certain imaging conditions only the central portion of the charging roller 2*a* may unexpectedly come into contact with the photoreceptor surface. It will be difficult to adapt to the disturbance of the photoreceptor surface caused by the charging roller 2*a* coming into contact with the photoreceptor 1 in this sort of localized, unpredictable manner. Consequently, when the photoreceptor is charged by a non-contact charging method, it is more preferable to use a hard material that is capable of uniformly maintaining a minute gap between the charging roller and the photoreceptor.

<Charging roller surface layer> Such materials as those described below, for example, may be used as the hard surface material of the charging roller 2*a*. The resistance adjustment layer may be formed from a thermoplastic resin composition (polyethylene, polypropylene, polymethyl methacrylate, polystyrene and copolymers thereof, and the like) in which a polymeric ion conduction agent is dispersed, and the surface of the resistance adjustment layer may be given a coating hardened by a curing agent. This hardened coating treatment may be performed, for example, by dipping the resistance adjustment layer in a treatment solution that contains an isocyanate-containing compound. Alternatively, a hardened coating layer may be formed in advance on the surface of the resistance adjustment layer.

Figure 7:
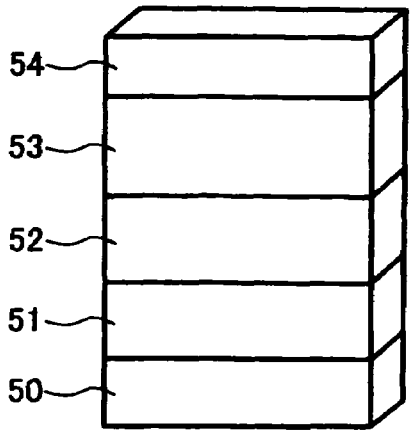
FIG. 7 is a cross-sectional diagram showing the structure of the photoreceptor.

The photoreceptor 1 used in the present embodiment is a negatively charged organic photoreceptor, and is a drum-shaped electroconductive support having a diameter of 30 mm on which a photosensitive layer or the like is provided. FIG. 7 is a cross-sectional drawing that shows the photoreceptor used in the present embodiment. An underlayer 51 (insulating layer) is provided on the electroconductive support 50 (base layer). The charge generation layer (CGL) 52 and charge transport layer (CTL) 53 as photosensitive layers are also formed thereon. The surface protection layer (FR) 54 is also stacked thereon.

<Electroconductive support 50> An electroconductive material having a volume resistivity of $10^{10}$ Ωcm or less may be used as the electroconductive support. It is possible, for example, to use a film-shaped or cylindrical plastic or paper base covered with aluminum, nickel, chrome, nichrome, copper, gold, silver, platinum, or another metal, or tin oxide, indium oxide, or another metal oxide by vapor deposition or sputtering; an aluminum, aluminum alloy, nickel, stainless steel, or other plate; or a tube or the like in which the abovementioned materials are formed into a tube by extrusion, drawing, or another process, and the tube is cut and is then surface-treated by superfinishing, polishing, or the like. The endless nickel belt and endless stainless steel belt disclosed in Japanese Unexamined Patent Application Publication No. 52-36016 may also be used as the electroconductive support.

A material in which electroconductive particles are dispersed in an appropriate binder resin and painted on the abovementioned support may also be used as the electroconductive support of the present invention. These electroconductive particles may include carbon black, acetylene black, aluminum, nickel, iron, nichrome, copper, zinc, silver, or other metal particles; electroconductive tin oxide, ITO, or other metal oxide particles; and the like. The binder resin used simultaneously may include polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin, and other thermoplastic, heat-curable resins or photo-curing resins. This type of electroconductive layer may be provided by dispersing these electroconductive particles and binder resins in an appropriate solvent; for example, tetrahydrofuran, dichloromethane, methyl ethyl ketone, toluene, or the like, and applying the product as a coating.

Furthermore, an electroconductive support that is suitable for use in the present invention may have an electroconductive layer provided by a heat-shrunk tube in which the aforementioned electroconductive particles are added to polyvinyl chloride, polypropylene, polyester, polystyrene, polyvinylidene chloride, polyethylene, chloride rubber, Teflon (registered trademark), or another raw material on an appropriate cylindrical base.

The photosensitive layer will next be described. The photosensitive layer may be single-layered or multilayered, but a multilayer configuration made up of a charge generation layer and a charge transport layer will first be described for convenience.

<Charge generation layer 52> The charge generation layer is a layer having a charge-generating substance as the main component thereof. A known charge-generating substance can be used in the charge generation layer, and useful typical examples thereof include monoazo pigments, disazo pigments, trisazo pigments, perylene-based pigments, perinone-based pigments, quinacridone-based pigments, quinone-based condensed polycyclic compounds, squalic acid-based dyes, other phthalocyanine-based pigments, naphthalocyanine-based pigments, azulenium salt-based dyes, and the like. These charge-generating substances may be used singly or as a mixture of two or more types thereof.

The charge generation layer is formed by dispersing a charge-generating substance together with a binder resin as needed using a ball mill, an attritor, a sand mill, ultrasonic waves, or the like in an appropriate solvent, and applying and drying this product onto the electroconductive support or the underlayer.

The abovementioned charge-generating substance may be dispersed in a binder resin as needed in the charge generation layer. Examples of usable binder resins include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinyl carbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulose-based resin, casein, polyvinyl alcohol, polyvinyl pyrrolidone, and the like. The quantity of the binder resin is appropriately 0 to 500 weight parts, preferably 10 to 300 weight parts, with respect to 100 weight parts of the charge-generating substance. The binder resin may be added before or after dispersion.

Isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexanone, toluene, xylene, ligroin, and the like are included as examples of solvents used herein, but ketone-based solvents, ester-based solvents, and ether-based solvents are particularly preferred for use. These solvents may be used singly or in mixtures of two or more types thereof.

The charge generation layer is primarily composed of a charge-generating substance, a solvent, and a binder resin, but sensitizers, dispersing agents, surfactants, silicone oil, or any other additive may be contained therein.

Dip coating, spray coating, beat coating, nozzle coating, spinner coating, ring coating, or another method may be used as the method of applying the coating fluid. The film thickness of the charge generation layer is appropriately about 0.01 to 5 μm, preferably 0.1 to 2 μm.

<Charge transport layer 53> The charge transport layer may be formed by dissolving or dispersing a charge-transporting substance and a binder resin in an appropriate solvent and applying and drying the product onto the charge generation layer. One or more types of plasticizers, leveling agents, antioxidants, and the like may also be added thereto as needed.

Charge-transporting substances include hole-transporting substances and electron-transporting substances.

Examples of electron-transporting substances include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxantone, 2,6,8-trinitro-4H-indeno[1,2-b]thiophen-4-one, 1,3,7-trinitrodibenzothiophene-5,5-dioxide, benzoquinone derivatives, and other electron-accepting substances.

Hole-transporting substances include poly-N-vinylcarbazole and derivatives thereof, poly-γ-carbazole ethyl glutamate and derivatives thereof, pyrene-formaldehyde condensates and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bis-stilbene derivatives, enamine derivatives, and other known materials. These charge-transporting substances may be used singly or in mixtures of two or more types thereof.

Binder resins include polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin, and other thermoplastic or heat-curable resins.

The quantity of the charge-transporting substance is appropriately 20 to 300 weight parts, preferably 40 to 150 weight parts, with respect to 100 weight parts of the binder resin. The film thickness of the charge transport layer is preferably 25 μm or less for the sake of resolution and responsiveness. The minimum value thereof varies according to the system used (particularly the charge potential and the like), but is preferably 5 μm or more.

Solvents used herein include tetrahydrofuran, dioxane, toluene, dichloromethane, monochlorobenzene, dichloroethane, cyclohexanone, methyl ethyl ketone, acetone, and the like. These solvents may be used singly or in mixtures of two or more types thereof.

A case in which the photosensitive layer has a single-layer structure will next be described. The photosensitive layer may be formed by dissolving or dispersing the aforementioned charge-generating substance, charge-transporting substance, binder resin, and the like in an appropriate solvent, and applying and drying this product onto the electroconductive support 50 or the underlayer 51. The photosensitive layer may also be formed from the charge-generating substance and the binder resin without including the charge-transporting substance. Plasticizers, leveling agents, antioxidants, and the like may also be added as needed.

Besides the binder resins cited earlier in the description of the charge transport layer, the binder resins cited in the description of the charge generation layer may also be mixed and used. The previously cited polymer charge-transporting substances may, of course, be suitable for use. The quantity of the charge-generating substance is preferably 5 to 40 weight parts with respect to 100 weight parts of the binder resin, and the quantity of the charge-transporting substance is preferably 0 to 190 weight parts, and more preferably 50 to 150 weight parts.

The photosensitive layer may be formed by applying a coating fluid in which the charge-generating substance and the binder resin are dispersed together with the charge-transporting substance by a dispersing machine or the like using tetrahydrofuran, dioxane, dichloroethane, cyclohexane, or another solvent by dip coating, spray coating, bead coating, ring coating, or another method. The film thickness of the photosensitive layer is appropriately about 5 to 25 μm.

<Underlayer 51> In the photoreceptor 1 according to the present embodiment, an underlayer may be provided between the electroconductive support and the photosensitive layer. The underlayer generally has a resin as its primary component, but a resin having high solvent resistance with respect to a common organic solvent is preferred when application of the photosensitive layer on the resin using a solvent is considered. Examples of such resins include polyvinyl alcohol, casein, sodium polyacrylate, and other water-soluble resins; copolymeric nylon, methoxymethylated nylon, and other alcohol-soluble resins; and polyurethane, melamine resin, phenol resin, alkyd-melamine resin, epoxy resin, and other curable resins capable of forming a three-dimensional lattice structure. Fine powder metal oxide pigments, examples of which include titanium oxide, silica, alumina, zirconium oxide, tin oxide, indium oxide, and the like, may be added to the underlayer for moiré prevention, reduction of residual electric potential, and other purposes. These underlayers may also be formed using an appropriate solvent and application method, as previously described in relation to the photosensitive layer. Furthermore, a silane coupling agent, a titanium coupling agent, a chromium coupling agent, or the like may be used as the underlayer of the present invention. Besides these underlayers, an underlayer provided with $Al_2O_3$ by anodic oxidation, or an underlayer provided with poly-paraxylylene (parylene) or another organic substance, or $SiO_2$, $SnO_2$, $TiO_2$, ITO, $CeO_2$, or another inorganic substance by a vacuum film formation method may be suitable for use as the underlayer of the present invention. Another publicly known underlayer may also be used. The film thickness of the underlayer is appropriately 0 to 5 μm.

<Protection layer 54> It is also possible to provide a protection layer 54 for preventing mechanical abrasion on the outermost surface layer of the photoreceptor. The protection layer 54 is formed, for example, by coating the surface of the photoreceptor with amorphous silicon in order to enhance its resistance to abrasion. A protection layer 54 containing alumina, tin oxide, inorganic particles, or the like may also be formed over the charge transport layer.

As described above, the structure of the photoreceptor 1 that can be used in the present embodiment is not limited in its specific configuration. Examples of acceptable configurations for the photoreceptor include a single-layer configuration in which only a photosensitive layer having a charge-generating substance and a charge-transporting substance as its main components is provided on an electroconductive support; a configuration in which a charge generation layer having a charge-generating substance as its main component and a charge transport layer having a charge-transporting substance as its main component are layered on an electroconductive support; a configuration in which a photosensitive layer having a charge-generating substance and a charge-transporting substance as its main components is provided on an electroconductive support, and a protection layer is further provided on the surface of the photosensitive layer; a configuration in which a charge generation layer having a charge-generating substance as its main component and a charge transport layer having a charge-transporting substance as its main component are layered on an electroconductive support, and a protection layer is further provided on the charge transport layer; and a configuration in which a charge transport layer having a charge-transporting substance as its main component and a charge generation layer having a charge-generating substance as its main component are layered on an electroconductive support, and a protection layer is further provided on the charge generation layer.

The toner of the present embodiment will next be described.

The toner of the present embodiment is contained in the developing device 4 together with a magnetic carrier. As shown in FIG. 1, the toner is stirred by a stirring roller 4*b* inside the developing device 4, and the toner is charged by friction. The friction-charged toner and the carrier are conveyed to the development roller 4*a*, a magnetic brush is formed on the development roller 4*a*, and the electrostatic latent image on the photoreceptor surface is converted to a toner image by the toner adhering to the magnetic brush coming into contact with the photoreceptor surface.

The toner of the present embodiment is composed of at least parent particles composed of a binder resin and a colorant, and an additive. The resin matrix can be obtained by melt-kneading a mixture composed of a binder resin and a colorant using a heat roller mill, cooling and hardening the product, and pulverizing and classifying the product. Additives are admixed into this resin matrix using a Henschel mixer or the like.

A publicly known binder resin for toner may be used as the abovementioned binder resin. Specific examples thereof include polystyrene, polychlorostyrene, polyvinyl toluene, and other styrenes and substituent monomers thereof; styrene/p-chlorostyrene copolymer, styrene/propylene copolymer, styrene/vinyl toluene copolymer, styrene/vinyl naphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/α-chloromethyl methacrylate copolymer, styrene/acrylonitrile copolymer, styrene/vinyl methyl ether copolymer, styrene/vinyl ethyl ether copolymer, styrene/vinyl methyl ketone copolymer, styrene/butadiene copolymer, styrene/isoprene copolymer, styrene/acrylonitrile/indene copolymer, styrene/maleic acid copolymer, styrene/maleic acid ester copolymer, and other styrene-based copolymers; and polymethyl methacrylate, polybutyl methacrylate, polyvinyl chloride, polyvinyl acetate, polyethylene, polypropylene, polyester, polyvinyl butyl butyrate, polyacrylic acid resin, rosin, modified rosin, terpene resin, phenol resin, aliphatic or alicyclic hydrocarbon resins, aromatic-based petroleum resins, chlorinated paraffin, paraffin wax, and the like. These may be used singly or in mixtures of two or more types thereof.

All publicly known colorants used for toner may be used as the abovementioned colorant. Examples of black colorants that may be used include carbon black, aniline black, furnace black, lamp black, and the like. Examples of cyan colorants that may be used include phthalocyanine blue, methylene blue, Victoria blue, methyl violet, aniline blue, ultramarine blue, and the like. Examples of magenta colorants that may be used include rhodamine 6G lake, dimethyl quinacridone, watching red, rose Bengal, rhodamine B, alizarin lake, and the like. Examples of yellow colorants that may be used include chrome yellow, benzidine yellow, Hansa yellow, naphthol yellow, molybdenum orange, quinoline yellow, tartrazine, and the like.

Furthermore, a small quantity of a charge-imparting agent; for example, a dye, a polarity-controlling agent, or the like, may be added to these toners in order to more efficiently impart a charge. Examples of polarity-controlling agents include monoazo dye metal complexes; nitrohumic acid and salts thereof; salicylic acid; naphthoic acid; Co, Cr, Fe, or other metal complexes of dicarboxylic acids; organic dyes; quaternary ammonium salts; and the like.

Inorganic particles are included in the abovementioned additives. Examples of inorganic particles may include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, and the like. The use of silica in the present embodiment is preferred because the toner can thereby be made to function with excellent charge stability.

The toner of the present embodiment will be described hereinafter based on experiments.

[Experiment 3]

First, the coverage ratio of the toner additive of the present embodiment will be described based on Experiment 3. The term "coverage ratio" used herein refers to the actual value measured by observation of the toner surface by SEM (scanning electron microscope), and is indicated by the equation below.

$$\text{Coverage ratio of additive} = 100 \times (\text{Sum of additive surface area})/(\text{Surface area of image processing region}) \quad \text{Equation (1)}$$

Figure 8A:
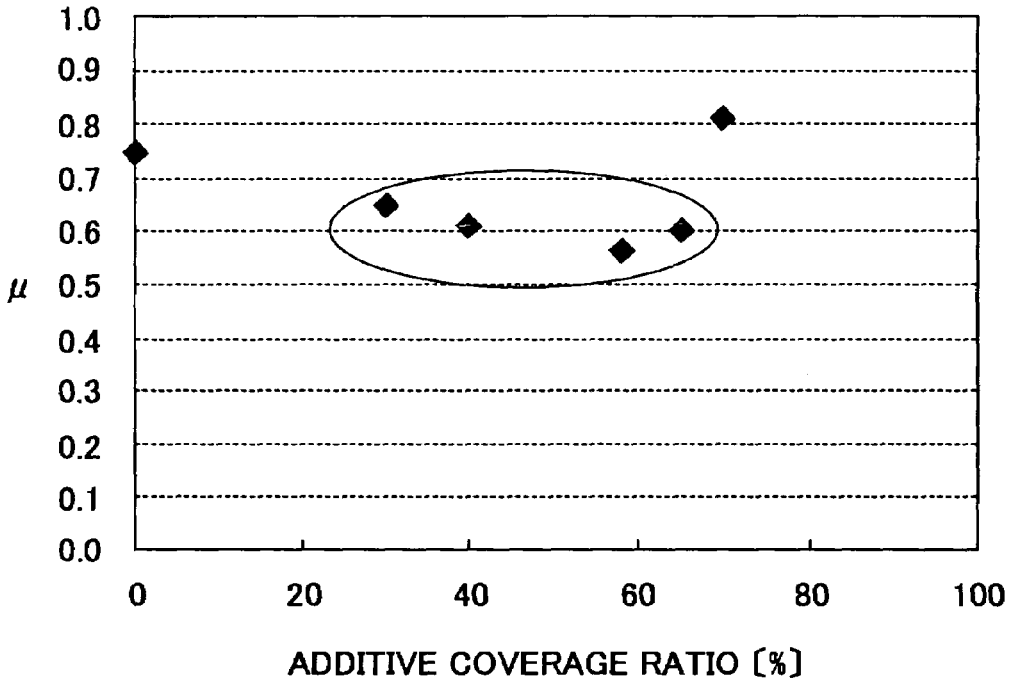
FIG. 8A is a graph on which the coefficient of friction between the toner and the photoreceptor with respect to the additive coverage ratio of the toner is plotted.

FIG. 8A shows the results of measuring the friction coefficient between the photoreceptor and the toner when the coverage ratio of the additive was varied. The friction coefficient is the value measured using an oiler belt method, and Printac tape having toner affixed thereon was used as the belt.

Figure 8B:
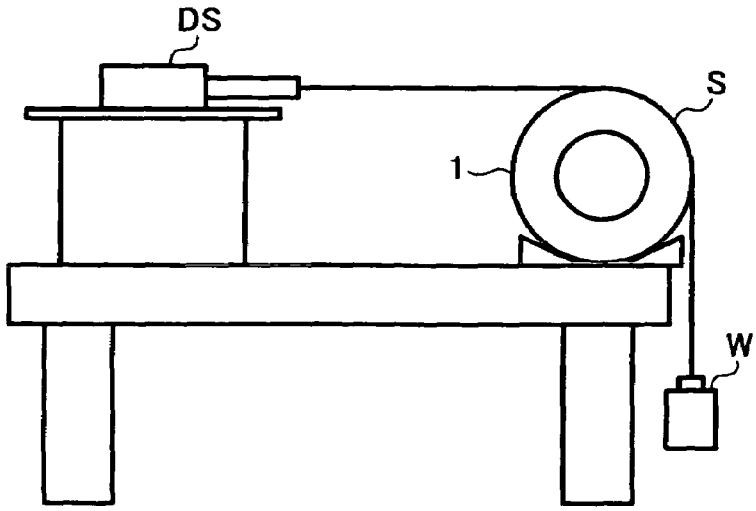
FIG. 8B is a diagram showing the experimental device for finding the coefficient of static friction by an oiler belt system.

The experimental mechanism for finding the coefficient of static friction by an oiler belt method is shown in FIG. 8B. As shown in the same drawing, a belt in which the toner was affixed to a Printac tape was used as measurement sample S. This measurement sample S was wrapped around a range of 90 degrees ($\pi/2$ rad) of the photoreceptor drum 1 in the peripheral direction thereof. A fixed weight W (0.98 N (100 g)) was attached to one end of the measurement sample S in the wrapping direction thereof, a digital push-pull gauge DS was attached to the other end thereof, the measurement sample S was pulled in a condition of constant speed and without the weight W shaking, and the value on the digital push-pull gauge DS at the moment the measurement sample S began to move on the surface of the photoreceptor drum 1 was measured. Designating the value measured at this time as F(N), the coefficient of static friction ($\mu$) was found according to the equation $\mu = \ln(F/0.98)/(\pi/2)$.

As is apparent from FIG. 8A, the toner in the additive coverage ratio range of 30% to 65% surrounded by the circle in FIG. 8A had a friction coefficient of 0.7 or less in relation to the photoreceptor. When the additive coverage ratio exceeded 65%, the friction coefficient abruptly increased, and ultimately exceeded 0.7. The friction coefficient also exceeded 0.7 when the additive coverage ratio became less than 30%. When the additive coverage ratio became less than 30%, the fluidity of the toner decreased, and an adequate amount of charge of the toner could not be obtained.

Figure 9:
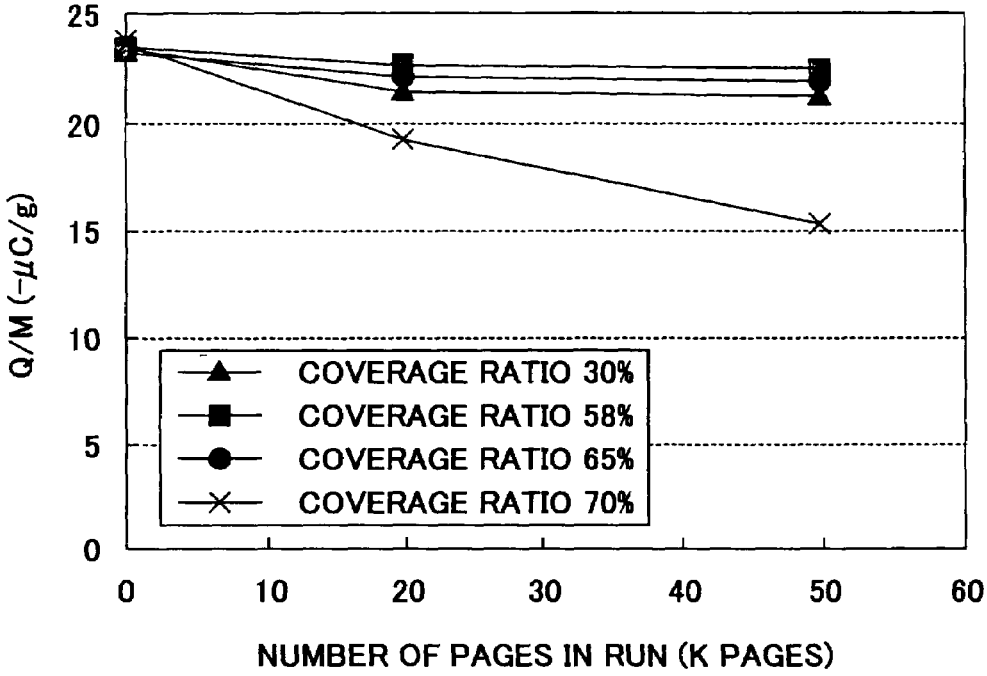
FIG. 9 is a graph on which the amount of toner charge with respect to the number of pages in the run is plotted for each toner additive coverage ratio.

The change in the toner charge quantity Q/M when a run was performed varying only the additive coverage ratio was then investigated for toner having the same particle diameter. Zinc stearate was used as a protective substance herein, and the quantity applied per unit surface area on the photoreceptor surface was set to 0.0002 mg/mm$^2$. Toner having a particle diameter of 7 μm was used, and silica was used as the sole additive. The results thereof are shown in FIG. 9. As shown in FIG. 9, the toner charge quantity was stable over time for the toner having an additive coverage ratio of 30 to 65%. It was learned that the toner charge quantity decreases as the number of pages in a run increases for toner having an additive coverage ratio of 70% or above.

Figure 10:
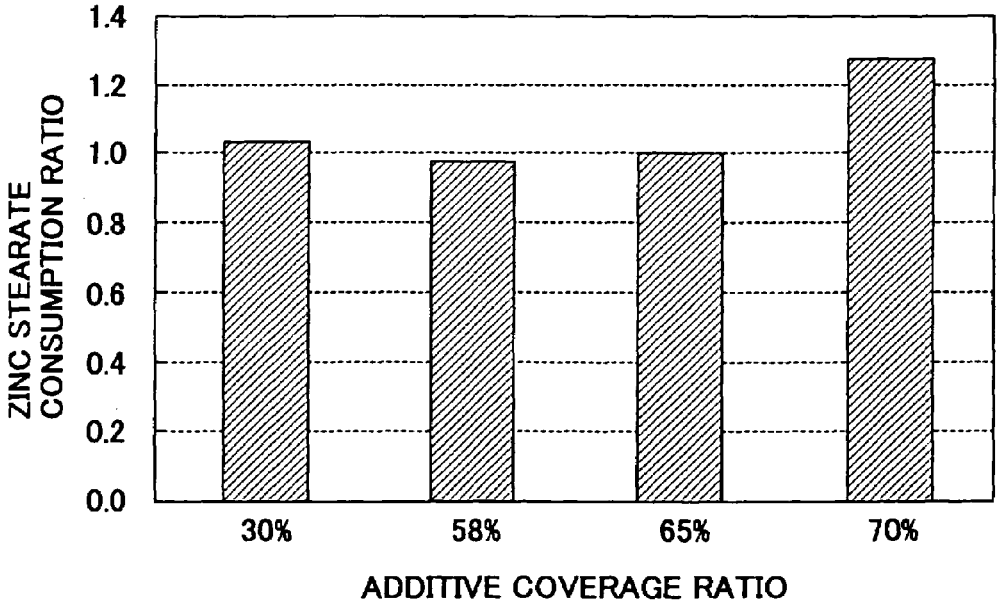
FIG. 10 is a diagram showing the quantity of zinc stearate consumed for each toner additive coverage ratio.

FIG. 10 shows the results of investigating the ratio of the consumption of zinc stearate after a run of 50,000 pages when the layer of zinc stearate as the protective substance on the photoreceptor surface was kept constant and the additive coverage ratio was varied. The consumption of zinc stearate when the additive coverage ratio was 65% was designated as 1. As is clear from FIG. 10, approximately 1.3 times the consumption of zinc stearate when the additive coverage ratio was 65% was consumed for the toner having an additive coverage ratio of 70% or higher.

It follows from these results that there was a friction coefficient of 0.7 or lower between the photoreceptor and the toner for toner having an additive coverage ratio of 35 to 65%. As a result, the amount of friction between the photoreceptor surface and the toner supported on the development roller could be reduced, and scraping off of the zinc stearate or other protective substance on the photoreceptor surface by the toner was therefore minimized. Accordingly, it was considered that intrusion of the protective substance into the developing device could be minimized, and it was therefore possible to obtain a stable toner charge quantity over time, as shown in FIG. 9. Also, the protective substance on the photoreceptor surface was not scraped off by the toner, for which reason the amount of the protective substance applied to the photoreceptor surface could be reduced, as shown in FIG. 10. The amount of the protective substance could thereby be reduced in comparison with the conventional configuration.

[Experiment 4]

The average roundness of the toner will next be described based on Experiment 4.

The average roundness of the toner is defined by the ratio between the circumference of a perfect circle having the same projected area as the toner particles and the peripheral length of the toner particles. This average roundness of the toner can be measured as an average roundness by an FPIA-1000 flow particle image analyzer (manufactured by Toa Medical Electronics Co., Ltd.), for example. In a specific example of a measurement method, 0.1 to 0.5 mL of a surfactant, preferably alkyl benzene sulfonate, are added as a dispersing agent to 100 to 150 mL of water in a vessel from which solid impurities are removed in advance, and about 0.1 to 0.5 g of a measurement sample are then added thereto. The sample dispersed in the suspension fluid is dispersed for approximately 1 to 3 minutes in an ultrasonic disperser, the concentration of the dispersion fluid is set to 3000 to 10,000 units/μL, and the shape and distribution of the toner are measured using the aforementioned device.

Figure 11:
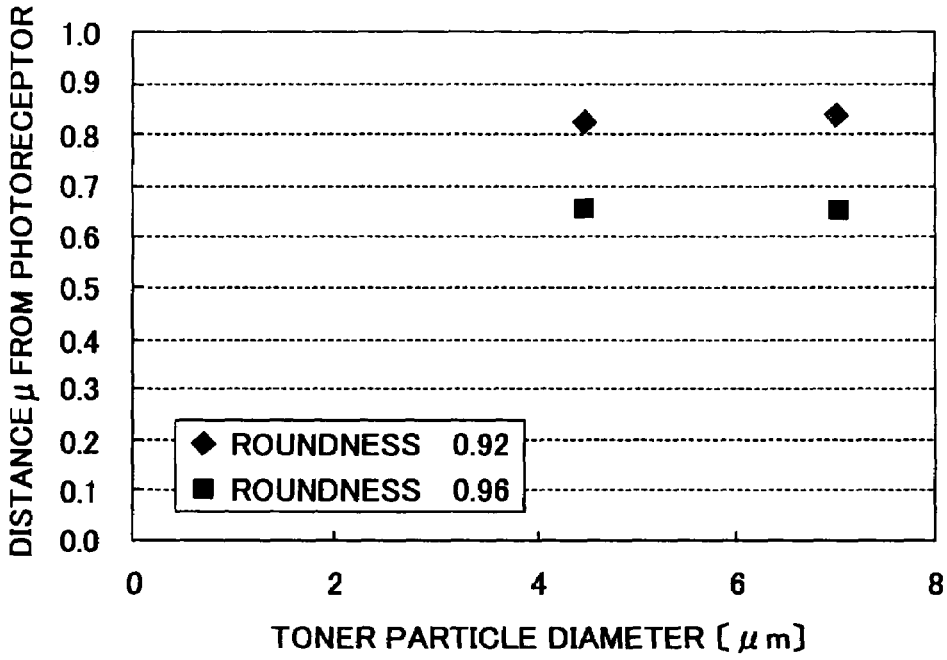
FIG. 11 is a graph on which the coefficient of friction between the toner and the photoreceptor with respect to the toner particle diameter is plotted for each average roundness of the toner.

In FIG. 11, the average roundness of the toner is varied, and the coefficient of friction between the toner and the photoreceptor is measured. The measured value of the friction coefficient is obtained using the same oiler belt method as in Experiment 3. As shown in FIG. 11, whereas the toner having an average roundness of 0.96 had a friction coefficient of 0.7 or lower regardless of its particle diameter, the toner whose roundness was 0.92 had a friction coefficient of 0.7 or higher.

Figure 12:
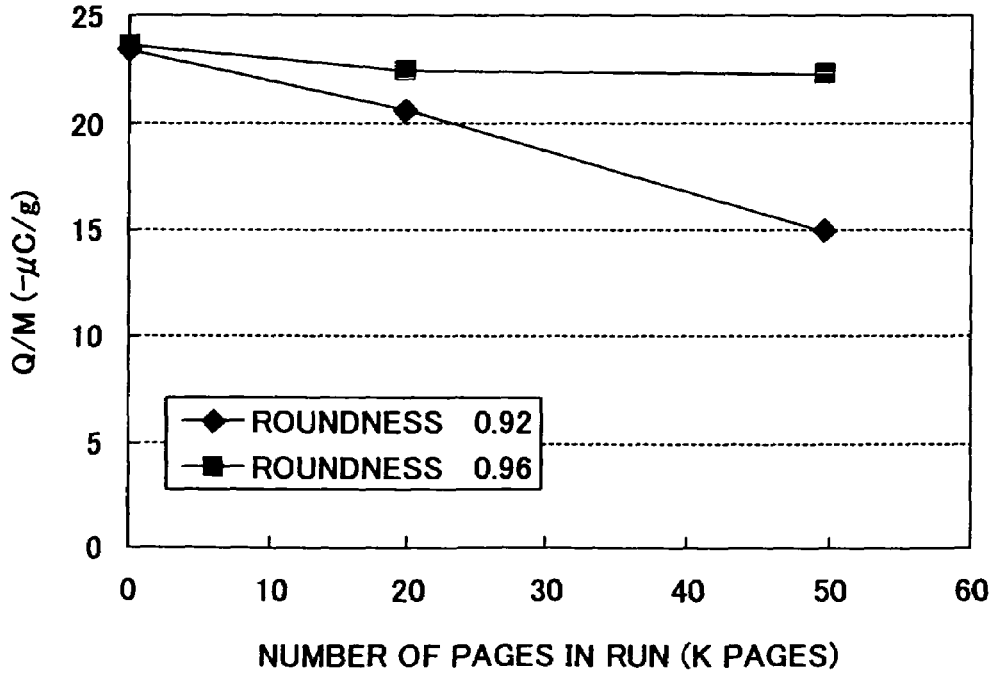
FIG. 12 is a graph on which the amount of toner charge with respect to the number of pages in the run is plotted for each average roundness of the toner.

FIG. 12 shows the change in the toner charge quantity Q/M when a run was performed with only the degree of roundness changed for toner of the same composition and particle diameter. Zinc stearate as a protective substance was applied in the amount of 0.0002 mg/mm$^2$ of surface area on the photoreceptor surface. Toner having a particle diameter of 7 μm was used. As is apparent from FIG. 12, the charge quantity of the toner having a roundness of 0.96 was stable over time. It is also apparent that the charge quantity of the toner having a roundness of 0.92 decreased as the number of pages in the run increased.

The layer of zinc stearate as the protective substance on the photoreceptor surface was set so as to remain constant, the additive coverage ration was varied, and the consumption of zinc stearate after a run of 50,000 pages was observed. At this time, the consumption of zinc stearate at a roundness of 0.96 was approximately ⅔ the consumption of zinc stearate at a roundness of 0.92.

From the above results, there was a friction coefficient of 0.7 or lower between the photoreceptor and the toner for toner having an average roundness of 0.96 or higher, and the amount of friction between the photoreceptor surface and the toner supported on the development roller could be reduced in the same manner as in Experiment 3. Therefore, scraping off of the zinc stearate or other protective substance on the photoreceptor surface by the toner was minimized, and intrusion of the protective substance into the developing device was minimized. It was believed that a stable toner charge quantity over time had been obtained as a result, as shown in FIG. 12. Also, it was considered that because there was no scraping of the protective substance on the photoreceptor surface by the toner, the amount of the protective substance applied to the photoreceptor surface could be reduced in comparison with a case in which toner having a roundness of 0.92 was used. The amount of the protective substance could thereby be reduced in comparison with the conventional configuration.

[Experiment 5]

The proportionality of extent to which the thickness of the film on the photoreceptor surface is significantly reduced during a discharge based on the application of alternating current to the AC voltage peak-to-peak voltage value Vpp (hereinafter referred to simply as "Vpp"), specifically, the amplitude of the alternating current component applied to the charging member, will next be described based on Experiment 5.

The following experiment was performed using an apparatus composed of a photoreceptor 1, charging device 2, and application device 30 such as is shown in FIG. 4A. All members that come into contact with the photoreceptor other than the charging roller 2*a* and the protective substance application device 30 were removed in advance so as not to cause degradation of the photoreceptor surface due to mechanical abrasion. The amount of film thickness reduction when the Vpp was varied and the surface of the photoreceptor 1 was continuously charged by a discharge based on the application of alternating current for 100 hours was measured. The experimental conditions were as shown below.

(Experimental Conditions)

Figure 13:
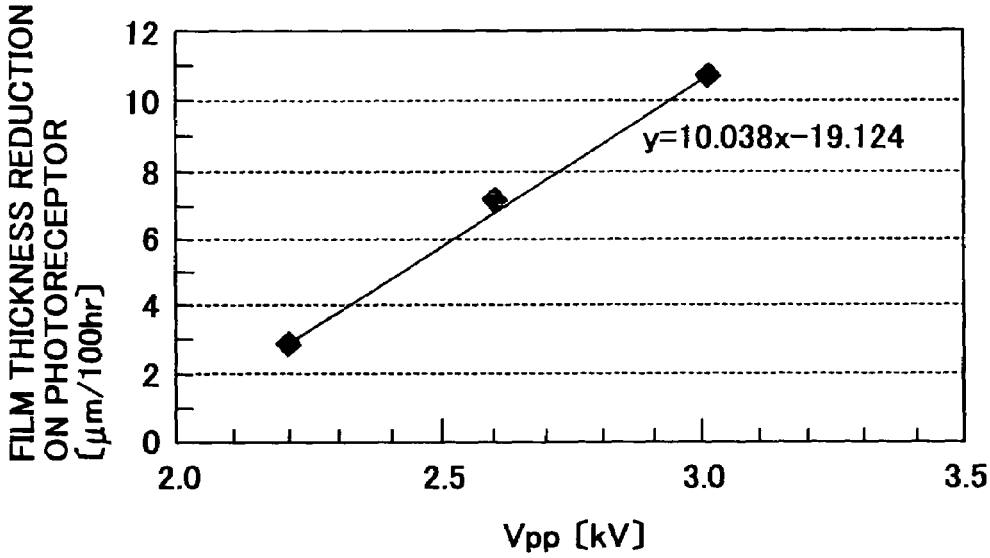
FIG. 13 is a graph showing the results of experimentation with the change in $V_{pp}$ on the horizontal axis, and the amount of film thickness reduction of the photoreceptor on the vertical axis.

Charging conditions:

Vpp (AC voltage peak-to-peak voltage value)=2.2, 2.6, and 3.0 kV f (frequency of AC voltage)=1350 Hz DC voltage value=−600 V Travel speed v of photoreceptor surface=133 mm/s Protective substance: zinc stearate Charging time: 100 hours In FIG. 13, the amount of film thickness reduction on the photoreceptor surface after charging by continuous discharge for 100 hours is plotted with respect to the Vpp. It is apparent from this graph that the film thickness reduction is proportional to the Vpp. It is also apparent that the amount of film thickness reduction decreases to zero when the Vpp is approximately 1.9 kV.

The inventors provide the following explanation for these results. It is known that if the voltage applied to the charging member is not at or above a prescribed value when an AC voltage is applied, discharge is not initiated between the charging member surface and the photoreceptor surface. According to research by the inventors, in the case of non-contact charging, discharge between the charging member surface and the photoreceptor surface is initiated when the voltage applied to the charging member is at or higher than the value shown in Equation 2 when the closest distance between the charging member surface and the charged surface is set to Gp (μm). This value will be indicated hereinafter as the discharge initiation voltage Vth.

$$Vth=312+6.2\times(d/\epsilon_{opc}+Gp/\epsilon_{air})+\sqrt{(7737.6\times d/\epsilon_{opc})} \quad \text{Equation (2)}$$

In the equation, d is the film thickness (μm) of the photoreceptor, $\epsilon_{opc}$ is the specific inductive capacity of the photoreceptor, and $\epsilon_{air}$ is the specific inductive capacity of the air between the photoreceptor and the charging member.

Discharge occurred in both directions between the charging member and the photoreceptor when the Vpp became twice the abovementioned Vth or higher.

In the present Experiment 5, since the gap between the charging roller and the photoreceptor was 50 μm, the specific inductive capacity of the photoreceptor was approximately 3, the film thickness of the photoreceptor was 30 μm, and the specific inductive capacity in the space between the photoreceptor and the charging member was approximately 1, Vth is equal to 962 V when these values are applied in the equation above. It was considered that discharge between the charging member surface and the photoreceptor surface was initiated when the voltage applied to the charging member was 962 V or above, and that discharge by AC voltage was initiated when the Vpp exceeded approximately 1924 V. It was believed that the bidirectional discharge generated by the AC voltage is the governing factor in the discharge phenomenon, and that the film thickness of the photoreceptor therefore begins to be reduced when the Vpp exceeds approximately 1.9 kV.

Experiment 6

The proportionality of the extent to which the thickness of the film on the photoreceptor surface is significantly reduced during a discharge based on the application of alternating current to the frequency f of the AC voltage will next be described based on Experiment 6.

The experimental conditions and the basic structure of the device used in the present experiment were the same as those in the abovementioned Experiment 5, but the charging conditions and the travel speed of the photoreceptor surface were different from those in Experiment 4 above. Specifically, the frequency f of the AC voltage was fixed and the Vpp was varied in the abovementioned Experiment 5, but in the present experiment, the Vpp was fixed and the frequency f of the AC voltage was varied.

(Experimental Conditions)

Figure 14:
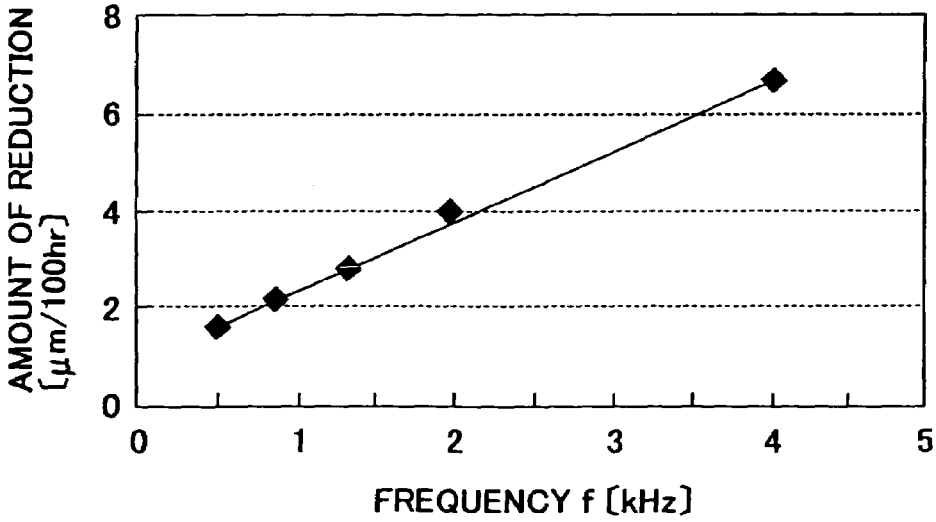
FIG. 14 is a graph showing the results of experimentation with the change in f on the horizontal axis, and the amount of film thickness reduction of the photoreceptor on the vertical axis.

Charging conditions:

Vpp (AC voltage peak-to-peak voltage value)=2.2 kV f (frequency of AC voltage)=500, 900, 1400, 2000, and 4000 Hz DC voltage value=−600 V Travel speed v of photoreceptor surface=104 mm/s Protective substance: zinc stearate Charging time: 100 hours In FIG. 14, the amount of film thickness reduction on the photoreceptor surface after continuous charging by the abovementioned discharge for 100 hours is plotted with respect to the frequency f of the AC voltage. It was apparent from this graph that the film thickness reduction was proportional to the frequency f of the AC voltage.

Experiment 7

Experimental results will next be described which show that the extent to which the thickness of the film on the photoreceptor is significantly reduced during a discharge based on the application of alternating current is proportional to (Vpp−2×Vth) and the frequency f of the AC voltage, and is inversely proportional to the travel speed v of the photoreceptor surface.

The experimental conditions and the basic structure of the device used in the present experiment were the same as those in the abovementioned Experiment 5, but in the present experiment, the presence of degradation of the photoreceptor surface was investigated while the Vpp, the AC voltage frequency f, the travel speed v of the photoreceptor surface, and the fed quantity of the protective substance were varied. Specifically, voltage was applied to the charging member continuously for 100 hours, and the presence of clouding and film thickness reduction on the photoreceptor surface with respect to the fed quantity of the protective substance was investigated. In order to know how much of the protective substance was actually being supplied under each condition, a sample to which only the protective substance was fed was created separately from that used to measure film thickness reduction in a state in which no voltage was applied to the charging member, and the quantity (elemental proportion) of elemental zinc (Zn) present on the photoreceptor surface was measured by XPS (X-ray photoelectron spectroscopy). The value (elemental proportion) obtained by measuring the elemental zinc (Zn) was the value obtained when application of zinc stearate was continued without voltage being applied to the charging member, and the photoreceptor surface was measured at the stage at which 5 hours had elapsed.

(Experimental Conditions)

Charging conditions:

Vpp (AC voltage peak-to-peak voltage value)=2120 and 3000 V f (frequency of AC voltage)=877.2 and 1350 Hz DC voltage value=−600 V Travel speed v of photoreceptor surface=125 and 185 mm/s Protective substance: zinc stearate The layer immediately under the protective substance in the photoreceptor 1 used in the present embodiment was the protection layer 54 for preventing mechanical abrasion, and the layer under the same was the charge transport layer 53, but since there is no zinc in these layers, the elemental proportions of elemental zinc (Zn) thus measured all originated from the zinc stearate used as the protective substance.

FIG. 15 shows the photoreceptor surface state (presence of clouding, and the reduction in film thickness) and the elemental proportion (%) results for elemental zinc (Zn) detected by XPS when the conditions that include X, the photoreceptor travel speed v, the Vpp, and the AC voltage frequency f were varied and experiments were performed. The condition X herein is indicated by the following equation.

$$X=\{Vpp-2\times Vth\}\times f/v \qquad \text{Equation (3)}$$

Figure 16:
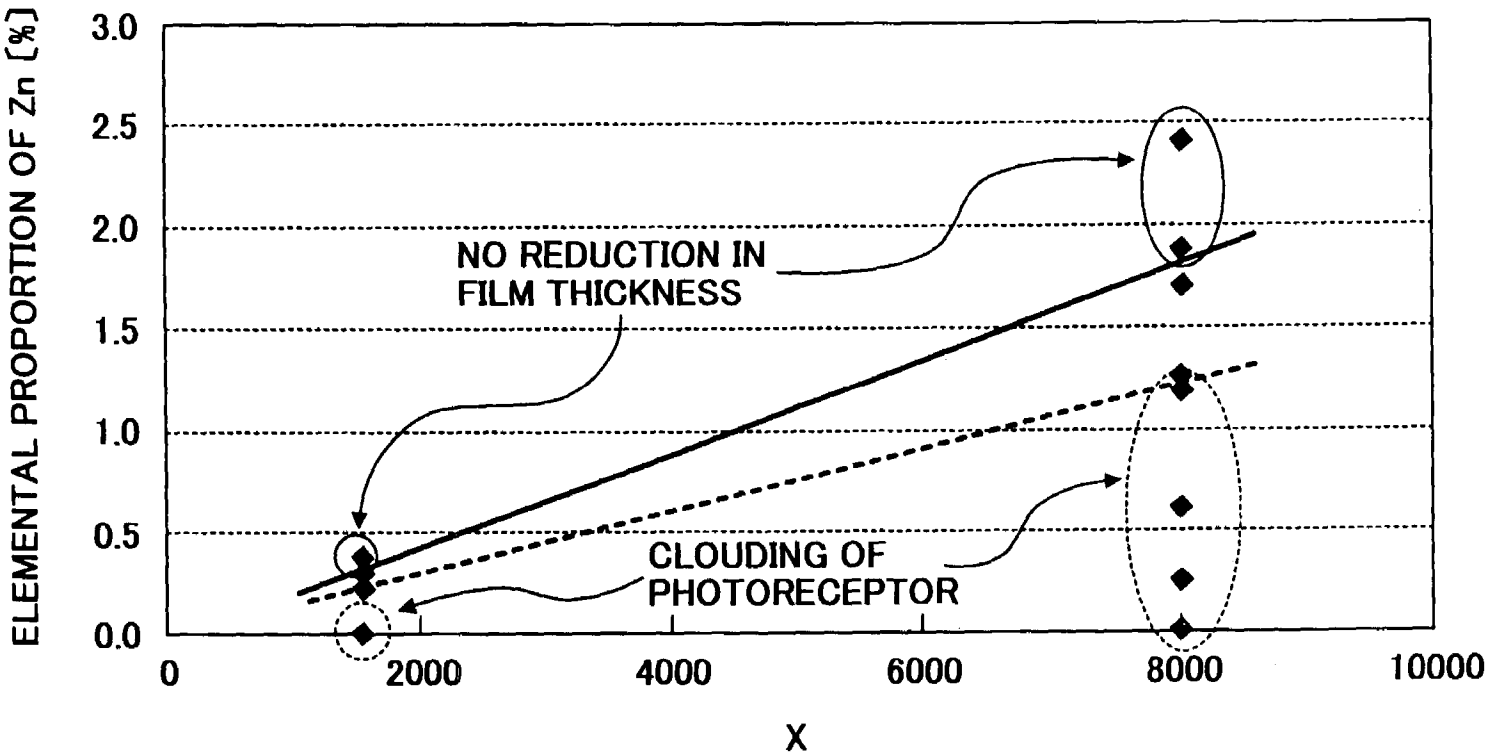
FIG. 16 is a graph showing the relationship between $\{V_{pp}-2\times Vth\}\times f/v$ and Zn.

In FIG. 16, the elemental proportion (%) of elemental zinc detected by XPS is plotted with respect to the combined quantity of all elements of the substance constituting the outermost surface of the photoreceptor as detected by XPS in the discharge region for X, based on the experimental results in FIG. 15. It is apparent from this figure that the elemental proportion of elemental zinc (Zn) necessary for preventing degradation (clouding) of the photosensitive surface by electrical discharge must be equal to or greater than that indicated by the following equation (4). It is also apparent that the elemental proportion of elemental zinc (Zn) necessary for preventing the thickness of the film on the photosensitive surface from being reduced by electrical discharge must be equal to or greater than that indicated by the following equation (5).

$$52\times10^{-4}\times\{Vpp-2\times Vth\}\times f/v \qquad \text{Equation (4)}$$

$$22\times10^{-4}\times\{Vpp-2\times Vth\}\times f/v \qquad \text{Equation (5)}$$

The quantity of zinc stearate detected by XPS that must be present in order to prevent degradation of the photoreceptor surface based on the content ratio of elemental zinc obtained in this manner is as described below. Specifically, degradation (clouding) of the photoreceptor can be prevented if the elemental proportion (%) of zinc stearate as detected by XPS with respect to the combined quantity of all the elements of the substance constituting the outermost surface of the photoreceptor as detected by XPS is set equal to or greater than equation (6). Furthermore, almost no film thickness reduction occurs if the elemental proportion (%) of zinc stearate as detected by XPS with respect to the combined quantity of all the elements of the substance constituting the outermost surface of the photoreceptor as detected by XPS is set equal to or greater than equation (7) based on the content ratio of elemental zinc.

$$23\times10^{-3}\times\{Vpp-2\times Vth\}\times f/v \qquad \text{Equation (6)}$$

$$10\times10^{-3}\times\{Vpp-2\times Vth\}\times f/v \qquad \text{Equation (7)}$$

A possible reason that the significant chemical degradation of the photoreceptor surface during a discharge based on the application of alternating current fluctuates according to the applied quantity of zinc stearate is described below. The energy of particles (electrons, excited molecules, ions, plasma, and the like) that is generated by electrical discharge in the discharge region of the photoreceptor surface is projected onto the photoreceptor surface layer. This energy resonates with the bond energy of molecules that constitute the photoreceptor surface and is absorbed; molecular weight reduction due to breakage of the resin molecule chain, reduction of the degree of intertwining of the polymer chain forming the outermost surface layer, and other chemical degradation occurs in the charge transport layer; and the film thickness is reduced.

When a protective substance is present on the photoreceptor surface, this substance receives direct irradiation from the particle energy generated by electrical discharge, and the photoreceptor is therefore prevented from being subjected to irradiation with the particles generated by electrical discharge. Therefore, it is considered that the protective substance absorbs the energy of the particles generated by electrical discharge, and chemical degradation of the photoreceptor surface is alleviated. Also in the experiment shown in FIG. 4, debris from the molecules constituting the photoreceptor was detected by analysis of the photoreceptor surface in region B of the photoreceptor 1 in which there was no protective substance, but debris from molecules constituting the photoreceptor was not detected for region A in which the protective substance was present, and the photoreceptor surface under the protective substance had not degraded. The zinc stearate fed to region A as the protective substance also underwent a chemical change, and decomposed matter was detected.

The experiments show that it is possible to use various types of substances as the abovementioned protective substance 32. The zinc stearate used in the image forming apparatus of the present embodiment is an example of the protective substance 32, and it is possible to use various types of fatty acid salts, waxes, silicone oils, and other substances as the protective substance 32.

Among fatty acid salts, the metal elements in metal salts of fatty acids easily become the characteristic element measured by XPS, and measurement thereof is easily performed after the applied quantity and other conditions are set. Consequently, they are also suitable when a device is designed for feeding the optimum quantity of the protective substance to the photoreceptor surface according to the charging conditions, as in the present embodiment.

Examples of suitable fatty acids include undecylic acid, lauric acid, tridecylic acid, myristic acid, palmitic acid, pentadecylic acid, stearic acid, heptadecylic acid, arachidic acid, montanic acid, oleic acid, arachidonic acid, caprylic acid, capric acid, caproic acid, and the like, and metal salts thereof include salts of zinc, iron, copper, magnesium, aluminum, calcium, and other metals.

A lamellar crystal powder such as zinc stearate is suitable for use as the protective substance. A lamellar crystal has a layered structure in which amphiphilic molecules are self-organized, and the crystal readily splits along its interlaminar spaces when a shear force is applied thereto. This action has the effect of reducing the friction coefficient, but also when viewed from the perspective of protecting the photoreceptor surface from electrical discharge, the properties whereby a lamellar crystal continues to uniformly cover the photoreceptor surface under shear force make it preferred as the protective substance because the photoreceptor surface can be effectively covered by a small quantity of the protective substance.

In order to fully take advantage of the characteristics of a lamellar crystal in protecting the photoreceptor surface from electrical discharge, it is preferred that the rotational speed of the protective substance application device 30 and the rotational speed of the photoreceptor surface be varied, and that the protective substance be applied while a shear force is applied.

When the object is to protect the photoreceptor surface from degradation by electrical discharge, as in the present invention, the protective substance application device 30 is preferably disposed between the cleaning device and the charging device. This is done in order to prevent the protective substance from being removed by the cleaning device before it reaches the discharge region.

A specific device according to the present embodiment will be described hereinafter that is capable of preventing chemical degradation of the surface of the photoreceptor 1.

Figure 17:
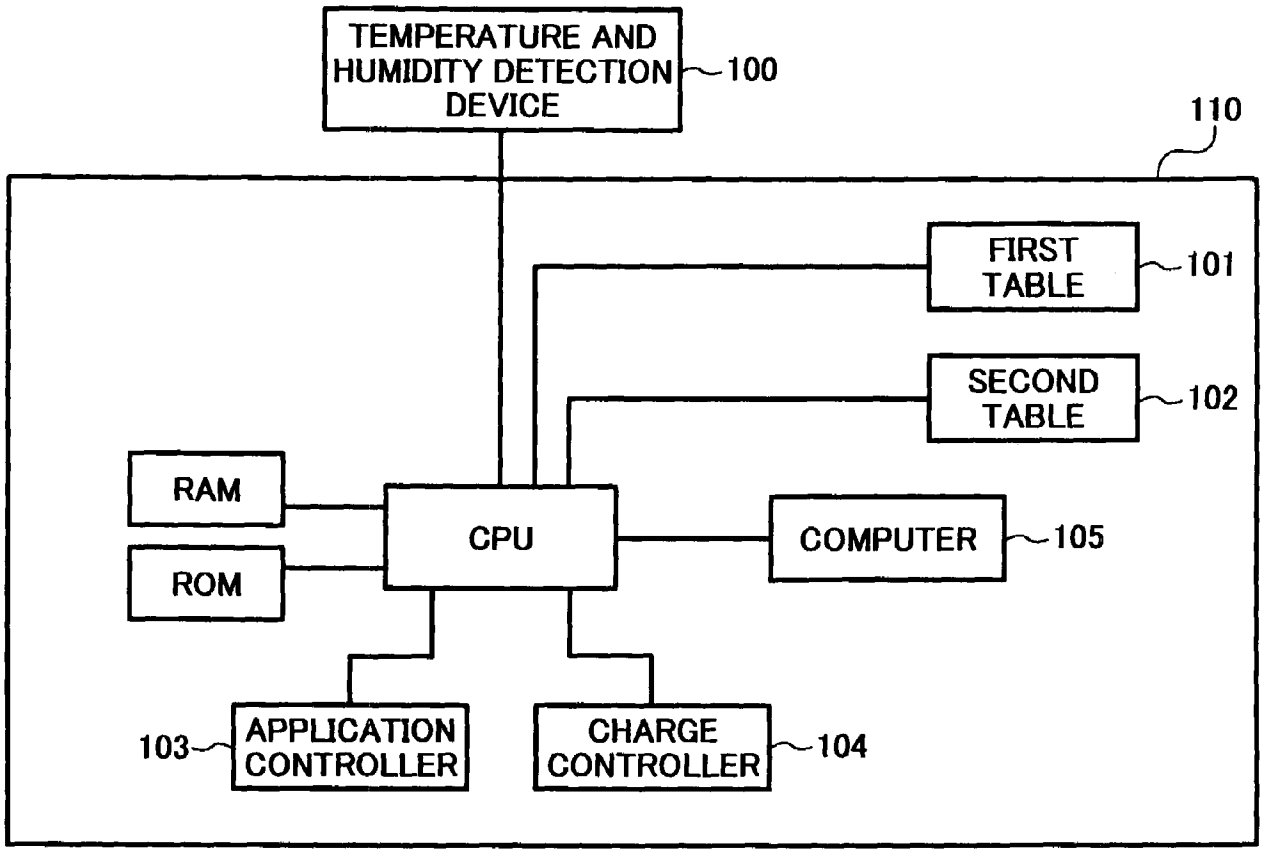
FIG. 17 is a diagram showing the structure of the control device for optimally applying the protective substance.

FIG. 17 is a block diagram showing the electrical unit for preventing chemical degradation of the surface of the photoreceptor 1. In the diagram, the controller (main controller) 110 has a CPU, RAM, and ROM, and this controller performs control aimed at preventing chemical degradation of the photoreceptor surface. A program described hereinafter is stored in the ROM. The CPU executes this program while utilizing the RAM accordingly. The controller 110 is provided with a first table 101 in which the rotational speed of the fur brush 31 is correlated with the quantity of the protective substance 32 fed to the surface of the photoreceptor 1; a second table 102 in which the environment surrounding the charging roller 2*a* detected by a temperature and humidity detection device 100 is correlated with the charging conditions; an application controller 103 for controlling the rotational speed of the fur brush 31; a charge controller 104 for controlling the charging conditions; and a computer 105 for computing the necessary quantity of the protective member according to the charging conditions. The temperature and humidity detection device 100, the charging device 2, the protective substance application device 30, and other components are electrically connected to the controller 110. The first table 101 or the second table 102 may be formed in the ROM. A configuration may also be adopted whereby the computer 105 stores a program for this computation procedure in the ROM in advance, and the computing function is performed by the CPU executing this program.

The first table 101 contains data in which the elemental ratio of Zn obtained as a result of measurement by the abovementioned XPS is coordinated with the rotational speed of the fur brush in order to apply the zinc stearate that must be applied to the photoreceptor surface so that chemical degradation of the surface of the photoreceptor 1 does not occur. The second table 102 contains data in which the temperature and humidity values are coordinated with the Vpp value needed for electrical discharge so as to enable electrical discharge to be generated by AC voltage reliably even when the discharge initiation voltage changes due to a change in the environment surrounding the charging roller. The computer 105 is set so as to be capable of computing the required elemental proportion (%) of zinc according to equation (11) or (12) above in order to compute the quantity of the protective member that is necessary according to the charging conditions.

Figure 18:
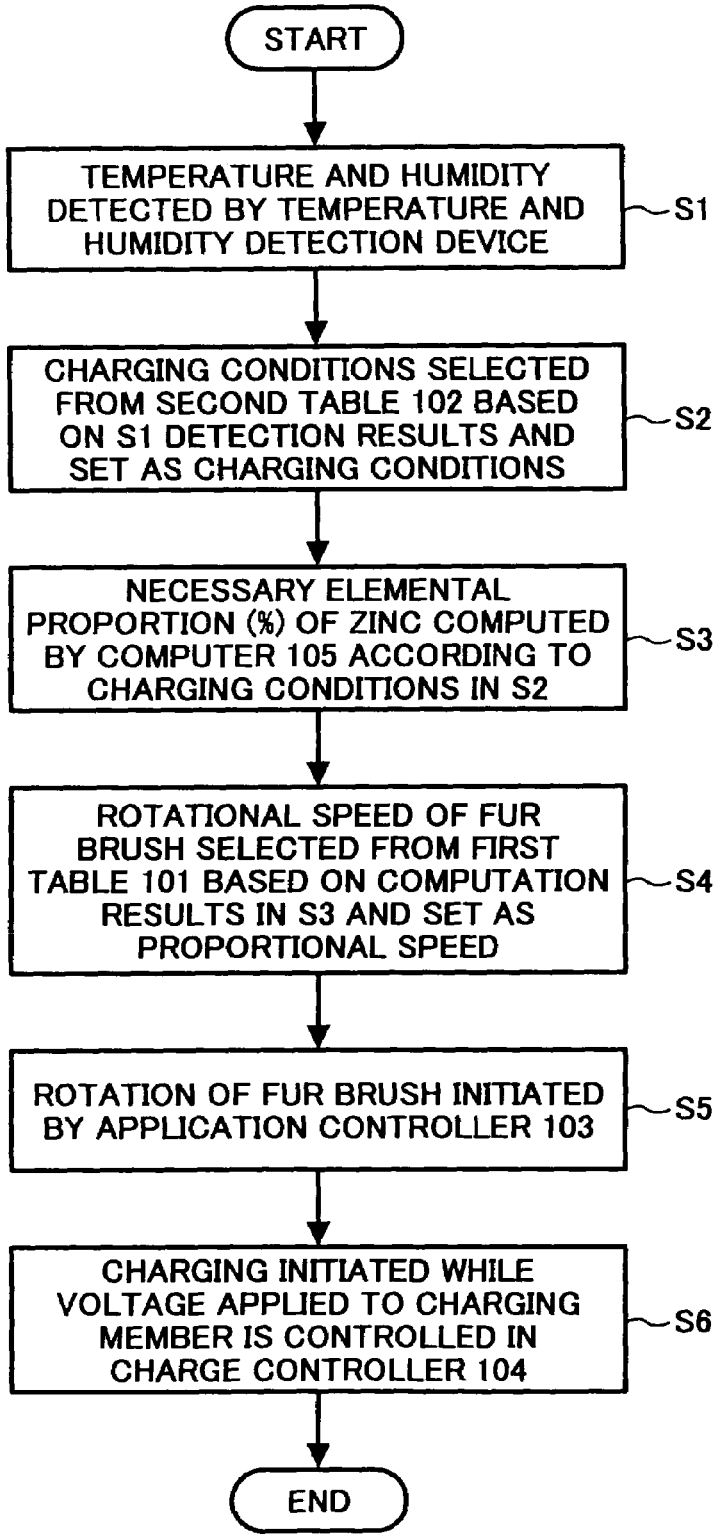
FIG. 18 is a flowchart relating to the procedure for initiating charging.

FIG. 18 is a flowchart relating to the procedure for determining the charging conditions and the rotational speed of the brush. Before charging is initiated by the controller 110 according to the inputting of a command for initiating image formation, the temperature and humidity (environmental conditions) around the charging device are detected using the temperature and humidity detection device (step S1). Charging conditions (Vpp value) stored in advance in the second table 102 are selected based on the detection results in step S1, and are set as the charging conditions (step S2). The elemental proportion (%) of zinc in the zinc stearate applied in order to prevent degradation of the photoreceptor 1 surface according to the charging conditions set in step S2 is computed by the computer 105 (step S3). In order for the desired protective substance to be applied to the photoreceptor surface, the rotational speed of the fur brush is selected from the first table 101 on the basis of the elemental proportion (%) of zinc computed in step S3, and is set as the rotational speed (step S4). The fur brush is then rotationally driven in the application controller 103 so as to attain the rotational speed set in step S4 (step S5). Lastly, charging is initiated while the voltage applied to the charging member is controlled using the charge controller (step S6). A program for executing the above procedure is stored in the ROM as previously described.

By providing this type of control device, it becomes possible to supply the photoreceptor surface with the optimum protective substance and to prevent degradation of the photoreceptor, even when the charging conditions change according to the environment.

When the necessary element ratio of zinc stearate is computed according to equation (10) above, the Vth must be computed in conjunction with the reduction in film thickness of the photoreceptor. The controller therefore also has a storage device for storing the cumulative charging time, and a third table for deriving the film thickness of the photoreceptor from the cumulative charging time; and the Vth is computed by deriving the photoreceptor film thickness according to the cumulative charging time from the third table.

With the image forming apparatus of the present embodiment described above, a friction coefficient of 0.7 or lower is obtained between the toner and the photoreceptor surface. The force with which the toner rubs against the photoreceptor surface can thereby be reduced. The toner supported on the developer roller 4*a* thereby moves so as to slide over the photoreceptor surface, and scraping off by the toner of the protective substance affixed to the photoreceptor surface is minimized. As a result, intrusion of the protective substance into the developing device is minimized, and toner charging that is stable over time can be obtained. Degradation of the image by contamination and the like can thereby be minimized for a long period of time, and a satisfactory image can be maintained. Since the protective substance on the photoreceptor surface is not scraped off by the toner, the amount of the protective substance applied to the photoreceptor surface can be reduced. This makes it possible for less of the protective substance to be used than in the conventional configuration.

Since the average roundness of the toner is set to 0.96 or above, it is also possible to obtain a coefficient of friction between the toner and the photoreceptor surface of 0.7 or lower. The toner supported on the developer roller thereby moves so as to slide over the photoreceptor surface, and scraping off by the toner of the protective substance affixed to the photoreceptor surface is minimized. As a result, intrusion of the protective substance into the developing device is minimized, and a toner charge that is stable over time can be obtained. A satisfactory image can be maintained over a long period of time.

By setting the additive coverage ratio of the toner to 35 to 65%, it is also possible to obtain a coefficient of friction between the toner and the photoreceptor surface of 0.7 or lower. The toner supported on the developer roller thereby moves so as to slide over the photoreceptor surface, and scraping off by the toner of the protective substance affixed to the photoreceptor surface is minimized. As a result, intrusion of the protective substance into the developing device is minimized, and a toner charge that is stable over time can be obtained. A satisfactory image can be maintained over a long period of time.

The metal elements in metal salts of fatty acids easily become the characteristic element measured by XPS, and measurement thereof is easily performed after the applied quantity and other conditions are set. Thus, by using a metal salt of a fatty acid as the protective substance, the optimum quantity of the protective substance to be applied to the photoreceptor surface according to the charging conditions is easily computed. The protective substance application device 30 can thereby be easily designed.

By also using lamellar crystal particles as the protective substance, the protective substance can be more uniformly applied because it cleaves between layers under a shear force and spreads over the photoreceptor surface.

By using zinc stearate, which is a metal salt of a fatty acid in the form of a lamellar crystal powder, as the protective substance, the protective substance can be uniformly applied on the photoreceptor surface, and the protective substance application device 30 can easily be designed.

A system is employed in the image forming apparatus of the present embodiment whereby charging is performed without the charging roller coming into contact with the photoreceptor. By this configuration, adhesion of the protective substance to the charging roller is prevented, and the amount of protective substance present on the photoreceptor can be stabilized.

The surface layer of the charging roller is also composed of a resin material. It is thereby possible to minimize deformation of the charging member, and to minimize sudden localized disruption of the amount of the protective substance present.

The image forming apparatus according to the present embodiment also has an application device for applying the protective substance on the photoreceptor surface, and is set so as to vary the rotational speed of both the photoreceptor 1 and the portion of the brush roller 31 of the application device 30 that comes into contact therewith. Since it thereby becomes easier for the lamellar crystal powder as the protective substance to spread by crystal cleavage, the protective substance can be more effectively applied to the photoreceptor surface.

The image forming apparatus also has an environment detection device for detecting the environmental conditions around the charging member, and a protective substance feeding quantity controller for controlling the amount of the protective substance present on the photoreceptor based on the results of detection by the environment detection device. It thereby becomes possible to supply the photoreceptor with the optimum quantity of protective substance even under varying temperature or humidity, and chemical degradation of the photoreceptor can be prevented.

In the present embodiment, the process cartridge composed of the charging device 2, the photoreceptor 1, and the application device 30 is configured so as to be demountable from the image forming apparatus. Since this process cartridge is replaced as a whole, the quantity of the protective substance contained in the application device 30, the initial film thickness of the photoreceptor, and the like can easily be set to levels that are appropriate with respect to each other.

Second Embodiment

The present embodiment will be described in detail hereinafter with reference to the drawings.

Since FIGS. 1 through 6, 13, 14, and 16 referenced in the first embodiment above and most of the description relating thereto can also essentially be applied to the present embodiment, redundant description thereof is avoided to the extent possible, but some description will still be given that somewhat overlaps that of the first embodiment above.

First, the two-component developer according to the present embodiment composed of a toner and a carrier will be described.

A carrier in which a coating layer is formed as needed on a nucleus particle having magnetic properties is in common use.

A known magnetic particle has conventionally been used as the nucleus particle, and examples thereof may include iron, cobalt, nickel, and other ferromagnetic metals, as well as magnetite, hematite, ferrite, and other alloys or compounds.

Resins used in the coating layer include polyolefin resins such as polyethylene, polypropylene, polyethylene chloride, and chlorosulfonated polyethylene; polyvinyl and polyvinylidene-based resins such as polystyrene, acrylic resins (polymethyl methacrylate, for example), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride/vinyl acetate copolymers; styrene/acrylic acid copolymers; silicone resins or modified products thereof (modified products obtained from alkyd resins, polyesters, epoxy resins, polyurethanes, and the like) such as straight silicone resin composed of organosiloxane bonds; fluororesins; polyesters such as polyethylene terephthalate; polyurethanes; polycarbonates; amino resins such as urea/formaldehyde resin; epoxy resins; and the like.

Among these resins, acrylic resin, silicone resin or a modified product thereof, and fluororesin are preferred for preventing toner loss, and silicone resin or a modified product thereof is particularly preferred.

The method for forming the coating layer is the same as the conventional method, and the resin may be applied to the surface of the carrier nucleus particles by spraying, dipping, or another method.

A fine powder may be added to the coating layer for the purpose of carrier resistance adjustment and the like. The fine powder dispersed in the coating layer preferably has a particle diameter of about 0.01 to 5.0 μm. Preferably 2 to 30 weight parts of the fine powder are added with respect to 100 weight parts of the coating resin, and addition of 5 to 20 weight parts is particularly preferred.

The fine powder may be a conventional, publicly known product, and examples thereof may include silica, alumina, titania, and other metal oxides, as well as carbon black and other pigments.

A carrier having a saturation magnetization value of 40 to 80 emu/g with respect to an applied magnetic field of 1000 oersted is used in the present embodiment. The saturation magnetization herein was measured using a BHU-60 magnetization measuring device (manufactured by Riken Measurement). It was learned from investigation by the inventors that defects whereby the protective substance applied to the photoreceptor surface contaminates the developing agent can be minimized if the saturation magnetization value of the carrier is within the abovementioned range. This is considered to be due to the hardness of the magnetic brush, and the action whereby the magnetic brush thus formed scrapes the photoreceptor surface is thought to vary according to the saturation magnetization value of the carrier.

Figure 19:
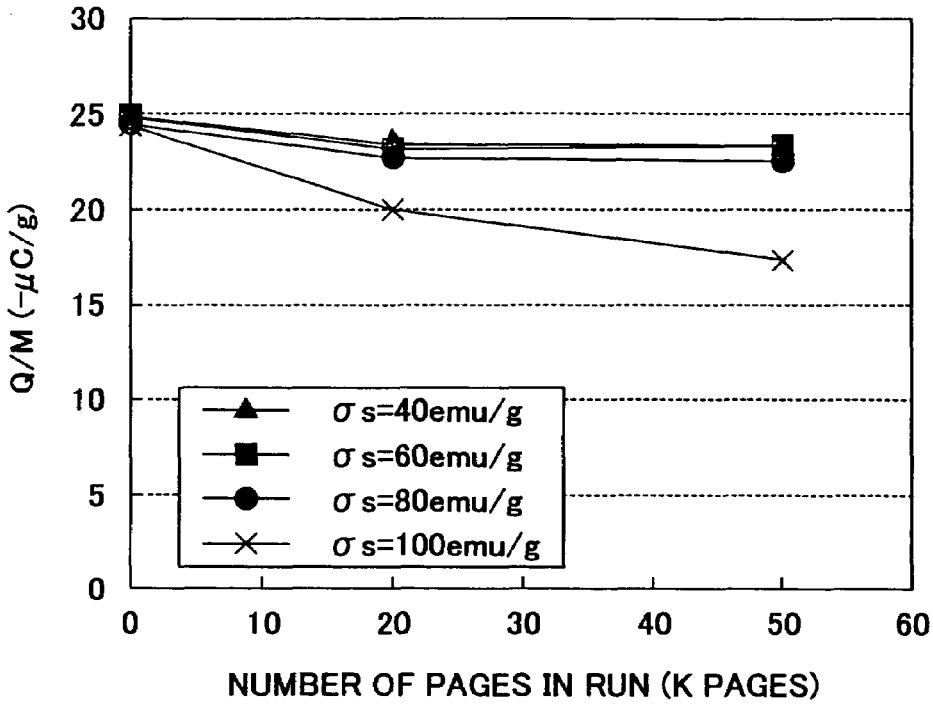
FIG. 19 is a graph showing the change in the developing agent charge amount when only the saturation magnetization value of the carrier is changed.
Figure 20:
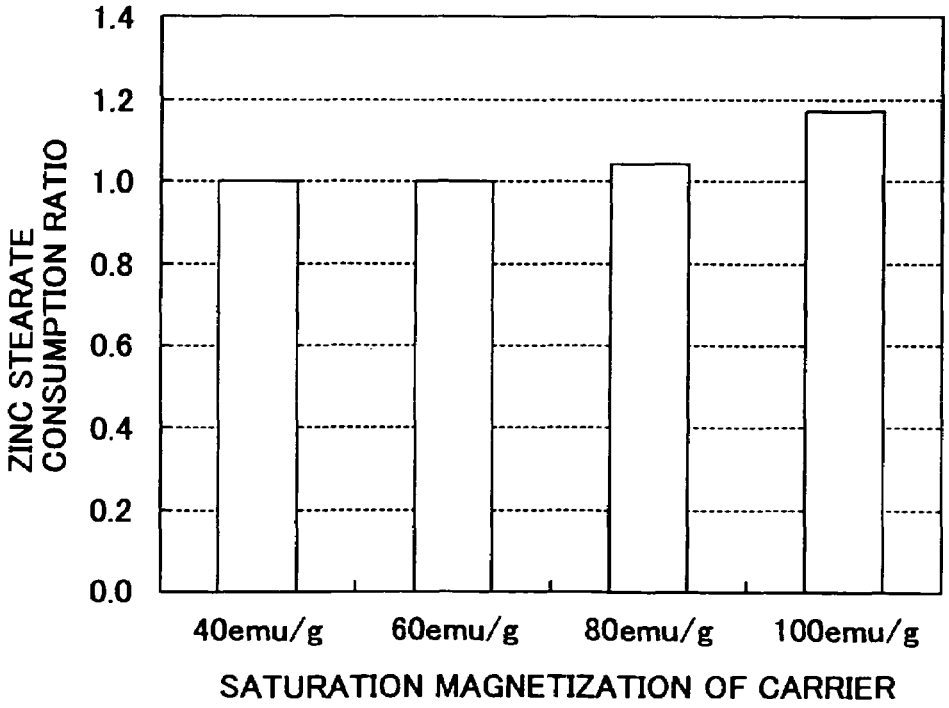
FIG. 20 is a graph showing the ratio of the consumed quantity of zinc stearate in relation to FIG. 19.

The change in the developer charge when only the saturation magnetization value of the carrier was changed is shown in FIG. 19. Zinc stearate was used as the protective substance in this case, and the quantity thereof applied per unit area of the photoreceptor surface was set to 0.0002 $mg/mm^2$. A carrier having a particle diameter of 55 μm was used. The ratio of consumption of zinc stearate at this time is shown in FIG. 20 (the case of a saturation magnetization of 40 emu/g was designated as 1).

The reduction in the charge of the developing agent during the run became severe when the saturation magnetization of the carrier exceeded 80 emu/g, and a large quantity of zinc stearate was consumed at that time. Therefore, in order to minimize scraping of the protective substance from the photoreceptor surface, a saturation magnetization value of 80 emu/g or below is desirable. The minimum value thereof is ideally 40 emu/g or above. A lesser value is not preferred, because even though no problems with scraping action arise, the carrier adheres more easily.

The results of investigation by the inventors as to the quantity of the protective substance required for protecting the photoreceptor surface will next be described. It was learned from investigation by the inventors that the conditions for protecting the photoreceptor surface from degradation by adjacent discharge are closely related to the charging conditions. Three experiments were performed using an experimental system composed only of a charging roller and a photoreceptor, and the state of degradation of the photoreceptor surface was observed. All of the experiments were performed using an experimental system composed only of the photoreceptor 1, the charging roller 2*a*, and the application device 30.

In the first experiment, the peak-to-peak voltage value Vpp of the AC voltage applied to the charging roller was changed to 2.2 kV, 2.6 kV, and 3.0 kV; the frequency f of the AC voltage was fixed at 1350 Hz; and the DC voltage was −600 V. The travel speed v of the photoreceptor surface was set to 113 mm/s. The results of the present experiment are plotted in FIG. 9 with the change in $V_{pp}$ on the horizontal axis, and the amount of film thickness reduction in the photoreceptor on the vertical axis.

It is clear from FIG. 13 that the reduction in the photoreceptor film thickness was proportional to the $V_{pp}$. The film thickness reduction was 0 when the $V_{pp}$ was approximately 1.9 kV. As previously mentioned concerning this result, it is known that if the voltage applied to the charging member is not at or above a prescribed value when an AC voltage is applied, discharge is initiated between the charging member surface and the photoreceptor surface. According to research by the inventors, in the case of non-contact charging, discharge between the charging member surface and the photoreceptor surface is initiated when the voltage applied to the charging member is at or higher than the value below when the closest distance between the charging member surface and the charged surface is set to Gp (μm). The discharge initiation voltage Vth is as previously described with reference to the abovementioned equation (2).

Discharge occurred in both directions between the charging member and the photoreceptor when the AC voltage $V_{pp}$ became twice the abovementioned Vth or higher. In the present embodiment, the gap between the charging roller and the photoreceptor was 50 μm, the specific inductive capacity of the photoreceptor was approximately 3, the film thickness was 30 μm, and the specific inductive capacity in the space between the photoreceptor and the charging member was approximately 1, and Vth is therefore equal to 962 V when these values are applied in the equation above. It was considered that discharge between the charging member surface and the photoreceptor surface was initiated when the voltage applied to the charging member became 962 V or above, and that discharge by AC voltage was initiated when the $V_{pp}$ exceeded approximately 1924 V. It was believed that the bidirectional discharge generated by the AC voltage was the governing factor in the discharge phenomenon, and that the film thickness of the photoreceptor therefore begins to be reduced when the $V_{pp}$ exceeds approximately 1.9 kV.

The second experiment corresponds to experiment 6 in the first embodiment described above. In this experiment, the frequency f of the AC voltage was changed to 500 Hz, 900 Hz, 1400 Hz, 2000 Hz, and 4000 Hz; the peak-to-peak voltage value $V_{pp}$ of the AC voltage was fixed at 2.2 kV; and the DC voltage was −600 V. The travel speed v of the photoreceptor surface was set to 104 mm/s. The results of the present experiment are plotted in FIG. 14 with the change in f on the horizontal axis, and the amount of film thickness reduction in the photoreceptor on the vertical axis.

It was apparent from FIG. 14 that the reduction in photoreceptor film thickness was proportional to f. As described above, the reduction in photoreceptor film was dependent on the charging conditions, and was specifically proportional to $V_{pp}$ and f.

The inventors therefore predicted that the reduction in photoreceptor film thickness was proportional to $V_{pp}-2\times Vth$ and to f, and was inversely proportional to the travel speed of the photoreceptor surface from the prediction that the amount of electrical discharge energy irradiated per unit of photoreceptor surface area is large even under charging conditions that are the same as if the travel speed of the photoreceptor were low. As a third experiment, the presence of degradation of the photoreceptor surface was investigated while $V_{pp}$, f, and the quantity of the protective substance were varied in an experiment for finding the quantity of the protective substance necessary in order to prevent degradation of the photoreceptor surface by electrical discharge. The results thereof are shown in FIG. 15. This experiment corresponds to experiment 7 in the first embodiment described above.

Specifically, the quantity of the protective substance in the present experiment is indicated by the elemental proportion (%) of zinc stearate. The trace quantity of the protective substance present on the photoreceptor surface is difficult to measure, but the inventors have succeeded in obtaining knowledge relating to the protective substance necessary for the photoreceptor surface by measuring the characteristic element (Zn) in the protective substance. The elemental proportion (%) of zinc stearate was measured using a Quantum 2000 scanning X-ray photoelectron spectroscope (XPS) manufactured by PH1, with an X-ray source of AlKα and an analysis area with a diameter of 100 μmϕ.

The measured value (elemental proportion) of Zn was the value obtained when the photoreceptor surface was measured at the stage at which 5 hours had elapsed while application of zinc stearate was continued without application of voltage to the charging member. Specifically, experiments in which a voltage was applied to the charging member were conducted first, and the amount of film thickness reduction or the presence of clouding was investigated, after which the image forming apparatus was operated for five hours under the same conditions, except that a voltage was applied to the charging member, and the quantity of zinc present therein was measured.

Since there was no zinc present on the surface layer (charge transport layer) in the photoreceptor 1 used in the present embodiment, all of the Zn thus measured originated from the zinc stearate used as the protective substance. The Zn can thus be considered to be the characteristic element that indicates the quantity of the protective substance. Even when a protective substance other than zinc stearate is used, the quantity of the protective substance can be known if the protective substance contains a characteristic element not present on the photoreceptor.

Considering that the molecular formula of zinc stearate is $[CH_3(CH_2)_{16}COO]_2Zn$, there are 36 C atoms, 4 O atoms, and 70 H atoms present for each atom of Zn. Since H is not detected by XPS, the elemental proportion of the protective substance that is detectable by XPS becomes 41 times the elemental proportion of Zn.

When the relationship between X and Zn was plotted from the results shown in FIG. 15 and a line indicating the boundary over which clouding is present or absent was found, it was apparent that the quantity of zinc stearate necessary for preventing degradation (clouding) of the photosensitive surface by electrical discharge must be equal to or greater than that indicated by the abovementioned equation (4); specifically, $$52\times10^{-4}\times\{V_{pp}-2\times Vth\}\times f/v\ (\%).$$

In this equation, $V_{pp}$ (V) is the peak-to-peak voltage (the difference between the maximum value of the AC voltage and the minimum value thereof) of the AC voltage applied to the charging member, f (Hz) is the frequency of the AC voltage applied to the charging member, and v (mm/s) is the travel speed of the photoreceptor surface. When the relationship between X and Zn was also plotted from the result shown in FIG. 15 and a line was found indicating the boundary over which reduction of the film thickness is present or absent, it was apparent that almost no reduction in film thickness occurs if the quantity of zinc stearate as indicated by the elemental proportion thereof is equal to or greater than that indicated by the abovementioned equation (5); specifically, $$22\times10^{-4}\times\{V_{pp}-2\times Vth\}\times f/v\ (\%).$$

The relationship between X and Zn described above is shown in FIG. 16. When the elemental proportion for the protective substance as a whole measured by XPS was calculated based on the content ratio of elemental zinc obtained in this manner, it was apparent that degradation (clouding) of the photoreceptor can be prevented if the elemental proportion was equal to that indicated by the abovementioned equation (6); specifically, $$23\times10^{-3}\times\{V_{pp}-2\times Vth\}\times f/v\ (\%),$$

and that almost no reduction in film thickness occurs if the elemental proportion was equal to or greater than that indicated by the abovementioned equation (7); specifically, $$10\times10^{-3}\times\{V_{pp}-2\times Vth\}\times f/v\ (\%).$$

The image forming apparatus of the present embodiment has a temperature and humidity detection device for detecting the environment around the charging roller. Furthermore, the image forming apparatus of the present embodiment has as part of a controller not shown in the drawing a first table in which the rotational speed of the fur brush is correlated with the quantity of the protective substance fed to the photoreceptor surface; a second table in which the environment surrounding the charging roller detected by a temperature and humidity detection device is correlated with the charging conditions; an application controller for controlling the rotational speed of the fur brush; a charge controller for controlling the charging conditions; and a computer for computing the necessary quantity of the protective member according to the charging conditions.

More specifically, the image forming apparatus has as the first table a table in which the rotational speed of the fur brush is correlated with the elemental proportion of Zn obtained from the results of measurement by XPS. The image forming apparatus also has as the second table a table in which the temperature and humidity values are correlated with the $V_{pp}$ value necessary for electrical discharge in order to reliably generate electrical discharge by AC voltage even when the discharge initiation voltage has changed due to a change in the environment surrounding the charging roller.

The computer also computes the elemental proportion of zinc stearate that is necessary according to equations (4) and (5) from the charging conditions in order to compute the quantity of the protective substance necessary according to the charging conditions.

In this configuration, the image forming apparatus of the present invention first detects the temperature and humidity (environmental conditions) using the temperature and humidity detection device when a command for initiating image formation is input, finds the charging conditions (Vpp value) using the second table from the temperature and humidity thus detected, computes the necessary elemental proportion of Zn based on the charging conditions using the computer, and finds the rotational speed of the fur brush from the first table based on the elemental proportion of Zn thus computed. The application controller rotates the fur brush at the optimum rotational speed according to the charging conditions ($V_{pp}$ value) thus obtained, and the charge controller initiates charging while controlling the voltage applied to the charging member. By this type of control, it becomes possible to supply the photoreceptor surface with the optimum protective substance and prevent degradation of the photoreceptor even when the charging conditions change according to the environment.

When the necessary elemental proportion of zinc stearate is computed according to equation (4), the Vth must be computed with consideration for the reduction of the film thickness of the photoreceptor. The controller therefore also has a storage device for storing the cumulative charging time, and a third table for deriving the film thickness of the photoreceptor from the cumulative charging time; and the Vth is computed by deriving the photoreceptor film thickness according to the cumulative charging time from the third table.

The present invention is not applied solely to an image forming apparatus such as the one shown in FIG. 1, but is also applicable to devices whereby a charge surface is charged using electrical discharge in general. For example, in the image forming apparatus of FIG. 1, the present invention may also be applied in a cleanerless-type image forming apparatus in which there is no dedicated cleaning device 7. In the image forming apparatus thus configured, the charging roller 2*a* is composed of a rubber material, and is a contact charging roller (Gp=0 μm) that is in contact with the photoreceptor 1. In this cleanerless-type image forming apparatus, since the protective substance is not removed by the cleaning device 7, the protective substance applied to the photoreceptor can remain thereon for a relatively long time, and the solid protective substance 32 in FIG. 1 can be further reduced in size. Degradation of the properties of the developer also becomes severe in this case when the developer is contaminated by the protective substance that is degraded by electrical discharge, but such contamination by the protective substance can be minimized if the saturation magnetization of the carrier is within the range of the present invention.

By the embodiments described above, not only is it possible to prevent degradation (degeneration; clouding) of the charged surface due to adjacent discharge in an image forming apparatus in which a system of charging by adjacent discharge is employed, but a stable image can be provided over a long period of time with little side effect on the developer, and further miniaturization of the apparatus can be anticipated.

Since the protective substance can cleave between layers and spread over the photoreceptor surface due to the sliding speed of the application device being different from that of the charged surface, efficient feeding of the protective substance becomes possible.

By also controlling the quantity of the protective substance fed to the charged surface based on the environmental conditions around the charging member, the optimum quantity of the protective substance can be determined according to the conditions even when the discharge initiation voltage changes according to environmental conditions of temperature and humidity.

A lamellar crystal powder is also preferred as the protective substance since it cleaves between layers and spreads over the charged surface when subjected to a shear force.

The amount of the protective substance present in the discharge area can also be stabilized by employing non-contact charging, in which it is difficult for the protective substance to adhere to the charging member.

When the surface layer of the charging member is composed of a resin material, it is also possible to minimize deformation of the charging member, and to minimize sudden localized disruption of the amount of the protective substance present.

Various modifications will become possible for those skilled in the art after receiving the teachings of the present disclosure without departing from the scope thereof.

What is claimed is:

1. An image forming apparatus comprising:

an object to be charged whose surface moves;

a charging device for charging the object to be charged using an electrical discharge generated by applying a voltage comprising an alternating current component to a charging member provided in contact with or in proximity to the object to be charged;

a latent image forming device for forming an electrostatic latent image on the surface of the object charged by the charging device; and a developing device for causing a two-component developer to come into contact with an image portion of the electrostatic latent image formed by the latent image forming device and affixing toner thereto; wherein a protective substance is present on the surface of the object to be charged in a discharge region for charging the object to be charged, and a saturation magnetization of the carrier of the two-component developer with respect to an applied magnetic field of 1000 oersted is from more than 50 to 80 emu/g.

2. The image forming apparatus as claimed in claim 1, further comprising an application device for applying the protective substance on the surface of the object to be charged, wherein a sliding speed of the application device in an area where it comes into contact with the object to be charged is different from the travel speed of the surface of the object to be charged.

3. The image forming apparatus as claimed in claim 1, further comprising a detection device for detecting the environmental conditions around the charging member; and a controller for controlling the quantity of the protective substance fed to the surface of the object to be charged based on the environmental conditions thus detected.

4. The image forming apparatus as claimed in claim 1, wherein the protective substance comprises a lamellar crystal powder.

5. The image forming apparatus as claimed in claim 1, wherein the protective substance comprises a metal salt of a fatty acid.

6. The image forming apparatus as claimed in claim 5, wherein the metal salt of a fatty acid is zinc stearate.

7. The image forming apparatus as claimed in claim 1, wherein a distance of closest approach between the charging member and the object to be charged is 1 to 100 μm.

8. The image forming apparatus as claimed in claim 7, wherein a surface layer of the charging member comprises a resin material.

9. A process cartridge integrally comprising:

an object to be charged whose surface moves;

a charging device for charging the object to be charged using an electrical discharge generated by applying a voltage comprising an alternating current component to a charging member provided in contact with or in proximity to the object to be charged;

a developing device for causing a two-component developer to come into contact with an image portion of an electrostatic latent image formed by eliminating the charge on the surface of the object charged by the charging device according to image information; and a feeding device for feeding a protective substance to the surface of the object to be charged in a discharge area for charging the object to be charged; wherein a saturation magnetization of the carrier of the two-component developer with respect to an applied magnetic field of 1000 oersted is from more than 50 to 80 emu/g.

10. An image forming apparatus comprising:

an object to be charged whose surface moves;

a charging device for charging the object to be charged using an electrical discharge generated by applying a voltage comprising an alternating current component to a charging member provided in contact with or in proximity to the object to be charged;

a latent image forming device for forming an electrostatic latent image on the surface of the object charged by the charging device; and a developing device for causing a two-component developer to come into contact with an image portion of the electrostatic latent image formed by the latent image forming device and affixing toner thereto; wherein a lamellar crystal powder is present on the surface of the object to be charged in a discharge region for charging the object to be charged, and a saturation magnetization of the carrier of the two-component developer with respect to an applied magnetic field of 1000 oersted is from 40 to 80 emu/g.

* * * * *